US008316930B2

(12) United States Patent
Clubb et al.

(10) Patent No.: US 8,316,930 B2
(45) Date of Patent: Nov. 27, 2012

(54) DOWNHOLE TUBULAR CONNECTOR

(75) Inventors: Matthew Clubb, Norwich (GB); Dougal Hugo Brown, Inverness (GB); Alan Payne, Inverurie (GB); Stuart Card, Aberdeen (GB); George Swietlik, Lowestoft (GB); Robert Large, Lowestoft (GB); Burney J. Latiolais, Lafayette, LA (US)

(73) Assignees: Pilot Drilling Control Limited, Lowestoft, Suffolk (GB); Frank's International, Inc., Houston, TX (US)

( * ) Notice: Subject to any disclaimer, the term of this patent is extended or adjusted under 35 U.S.C. 154(b) by 384 days.

(21) Appl. No.: 12/703,129

(22) Filed: Feb. 9, 2010

(65) Prior Publication Data

US 2010/0206584 A1 Aug. 19, 2010

Related U.S. Application Data

(63) Continuation-in-part of application No. 12/368,187, filed on Feb. 9, 2009, now Pat. No. 8,047,278, which is a continuation-in-part of application No. 11/703,915, filed on Feb. 8, 2007, now Pat. No. 7,690,422, application No. 12/703,129, filed on Feb. 9, 2010, which is a continuation-in-part of application No. PCT/GB2009/000344, filed on Feb. 9, 2009.

(30) Foreign Application Priority Data

| | | |
|---|---|---|
| Feb. 8, 2006 | (GB) | 0602565.4 |
| Feb. 8, 2008 | (GB) | 0802406.9 |
| Feb. 8, 2008 | (GB) | 0802407.7 |
| Mar. 20, 2008 | (GB) | 0805299.5 |

(51) Int. Cl.
*E21B 19/00* (2006.01)

(52) U.S. Cl. ..... 166/90.1; 166/378; 166/380; 166/381

(58) Field of Classification Search ..... 166/90.1, 166/378, 380, 381
See application file for complete search history.

(56) References Cited

U.S. PATENT DOCUMENTS 2,313,263 A 3/1943 Rea (Continued)

FOREIGN PATENT DOCUMENTS

EP 1019614 A1 7/2000

(Continued)

OTHER PUBLICATIONS

Office Action in U.S. Appl. No. 12/368,199; dated Dec. 21, 2010 (24 pages).

(Continued)

*Primary Examiner* — Giovanna Wright
(74) *Attorney, Agent, or Firm* — Osha Liang LLP

(57) ABSTRACT

A hydraulic connector to provide a fluidic connection between a fluid supply and a downhole tubular, the connector comprising: a body; an engagement assembly comprising an extendable portion selectively extendable from the body, the engagement assembly being configured to extend and retract a seal assembly disposed at a distal end of the extendable portion into and from a proximal end of the downhole tubular; and a valve assembly operable between an open position and a closed position, the valve assembly being configured to: allow a fluid to communicate between the fluid supply and the downhole tubular through the seal assembly when in the open position; and prevent fluid communication between the fluid supply and the downhole tubular when in the closed position.

24 Claims, 16 Drawing Sheets

U.S. PATENT DOCUMENTS

| | | | | |
|---|---|---|---|---|
| 2,659,440 | A | 11/1953 | Osmun | |
| 3,374,841 | A | 3/1968 | Current | |
| 3,874,634 | A | 4/1975 | Gazda | |
| 4,224,987 | A | 9/1980 | Allen | |
| 4,377,179 | A | 3/1983 | Giebeler | |
| 4,495,073 | A | 1/1985 | Beimgraben | |
| 5,033,551 | A | 7/1991 | Grantom | |
| 5,133,419 | A | 7/1992 | Barrington | |
| 5,518,072 | A | 5/1996 | McTernaghan | |
| 5,609,205 | A * | 3/1997 | Massie et al. | 166/163 |
| 5,735,348 | A | 4/1998 | Hawkins, III | |
| 6,390,190 | B2 * | 5/2002 | Mullins | 166/90.1 |
| 6,390,198 | B2 | 5/2002 | Brooks et al. | |
| 7,690,422 | B2 | 4/2010 | Swietlik et al. | |
| 2002/0129934 | A1 | 9/2002 | Mullins et al. | |
| 2006/0196673 | A1 | 9/2006 | Pallini et al. | |

FOREIGN PATENT DOCUMENTS

| | | | |
|---|---|---|---|
| EP | 1632640 | | 3/2006 |
| GB | 2074634 | A | 11/1981 |
| GB | 2435059 | A | 8/2007 |
| WO | 9307358 | | 4/1993 |
| WO | 0019060 | | 4/2000 |
| WO | 2005090740 | | 9/2005 |

OTHER PUBLICATIONS

Office Action in U.S. Appl. No. 12/368,187; dated Feb. 16, 2011 (27 pages).
Notice of Allowance in U.S. Appl. No. 12/368,199; dated Apr. 29, 2011 (9 pages).
International Search Report for Patent Application No. PCT/GB2010/000229, dated Apr. 6, 2010 (14 pages).
International Search Report for Patent Application No. PCT/GB2010/000230, dated Apr. 6, 2010 (14 pages).
Office Action in U.S. Appl. No. 12/368,217; dated Nov. 24, 2010 (18 pages).
Office Action in U.S. Appl. No. 12/368,161, dated Oct. 21, 2010 (26 pages).
Notice of Allowance in U.S. Appl. No. 12/368,217; dated May 11, 2011 (13 pages).
Office Action for U.S. Appl. No. 12/703,123 mailed Jun. 27, 2012 (12 pages).

* cited by examiner

DOWNHOLE TUBULAR CONNECTOR

CROSS-REFERENCE TO RELATED APPLICATION

The present application claims priority as a continuation-in-part, pursuant to 35 U.S.C. §119(e), to the filing dates of U.S. patent application Ser. No. 12/368,187, and PCT Patent Application No. PCT/GB2009/000344, both filed on Feb. 9, 2009, which are hereby incorporated by reference in their entirety.

BACKGROUND OF THE DISCLOSURE

1. Field of the Disclosure

The present disclosure generally relates to a connector establishing a fluid-tight connection to a downhole tubular. More particularly, the present disclosure relates to a connector establishing a fluid connection between a bore of a downhole tubular and a lifting assembly and/or a fluid supply.

2. Description of the Related Art

It is known in the well drilling industry to use a top-drive assembly (e.g., a quill thereof) to apply rotational torque to a series of inter-connected tubulars (commonly referred to as a drillstring comprised of drill pipe) to drill subterranean and subsea oil and gas wells. In other operations, a top-drive assembly may be used to install casing strings to already drilled wellbores, in which case the series of inter-connected tubulars may comprise a casing string or a drillstring connected to a casing string. As such, the present disclosure is not limited to a drillstring, but may also apply to other structures such as a casing string or a drillstring connected to a casing string. The top-drive assembly may include a motor, either hydraulic, electric, or other, to provide the torque to rotate the drillstring, which may in turn rotate a drill bit at a distal end of the well.

Typically, the drillstring comprises a series of threadably-connected tubulars (drill pipes) of varying length, typically about 30 ft (9.14 m) in length. Typically, each section, or "joint" of drill pipe includes a male-type "pin" threaded connection at a first end and a corresponding female-type "box" threaded connection at the second end. As such, when making-up a connection between two joints of drill pipe, a pin connection of the upper piece of drill pipe (e.g., the new joint of drill pipe) is aligned with, threaded, and torqued within a box connection of a lower piece of drill pipe (e.g., the former joint of drill pipe). In a top-drive system, the top-drive motor may also be attached to the top joint of the drillstring via a threaded connection on a quill of the top-drive.

During drilling operations, drilling mud is pumped through the connection between the top-drive and the drillstring. The drilling mud may travel through a bore of the drillstring and exits through nozzle or ports of the drill bit or other drilling tools downhole. The drilling mud performs various functions, including, but not limited to, lubricating and cooling the cutting surfaces of the drill bit. Additionally, as the drilling mud returns to the surface through the annular space formed between the outer diameter of the drillstring and the inner diameter of the borehole, the mud carries cuttings away from the bottom of the hole to the surface. Once at the surface, the drill cuttings are filtered out from the drilling mud and the drilling mud may be reused and the cuttings examined to determine geological properties of the borehole.

Additionally, the drilling mud may be useful in maintaining a desired amount of head pressure upon the downhole formation. As the specific gravity (e.g., density) of the drilling mud may be varied, an appropriate "weight" may be used to maintain balance in the subterranean formation. If the mud weight is too low, formation pressure may push back on the column of mud and result in a blow out at the surface. However, if the mud weight is too high, the excess pressure downhole may fracture the formation and may cause the mud to invade the formation, resulting in damage to the formation and/or a loss of drilling mud.

As such, there are times (e.g., to replace a drill bit, log, run casing, etc.) where it is desirable to remove (e.g., "trip out") the drillstring from the well and it becomes desirable to pump additional drilling mud (or increase the supply pressure) through the drillstring to displace and support the volume of the drillstring retreating from the wellbore to maintain the well's hydraulic balance. By pumping additional fluids as the drillstring is tripped out of the hole, a localized region of low pressure (e.g., suction) near or below the retreating drill bit and/or drillstring may be reduced and the force to remove the drillstring may be minimized. In a conventional arrangement, the excess supply drilling mud may be pumped through the same direct threaded connection between the top-drive and drillstring as used when drilling.

As the drillstring is removed from the well, successive sections (e.g., a stand of drill pipe) of the retrieved drillstring are disconnected from the remaining drillstring (and the top-drive assembly) and stored for use when the drillstring is tripped back into the wellbore. Following the removal of each joint (or series of joints) from the drillstring, a new fluidic connection may be established between the top-drive and the remaining drillstring. However, breaking and re-making these threaded connections, two for every section of drillstring removed, is time consuming thus slows down the process of tripping out the drillstring.

In addition to the above, a drillstring may be used as the mechanism to convey and land the casing string into position. As the drillstring is lowered, successive sections of drillstring may be added to lower the drillstring (and attached casing string) further. Once the casing has been cemented in place the drillstring may then be detached from the casing string and the drillstring may be removed from the well.

It should be understood that other types of "lifting assemblies" may be used instead of a top-drive assembly. For example, an elevator and lifting bales may be connected directly to a hook or other lifting mechanism to raise and/or lower the casing and/or drill pipe while hydraulically connected to a pressurized fluid source (e.g., a mud pump, a rotating swivel, an IBOP, a TIW valve, an upper length of tubular, etc.). This may be used when "running" casing or drill pipe on drilling rigs not equipped with a top-drive assembly.

In this regard, GB2435059 discloses a hydraulic connector which uses a seal to selectively connect to the exposed top end of the drillstring. For example, FIGS. 2*a* and 2*b* (collectively referred to as "FIG. 2") here, show a hydraulic connector 10 disclosed in GB2435059. Hydraulic connector 10 includes an engagement assembly including a main or primary cylinder 15 and a extendable portion 20 slidably engaged and configured to reciprocate within cylinder 15. As shown, extendable portion 20 includes a hollow tubular rod 30 configured to be slidably engageable within cylinder 15 so that a first (e.g., lower) end of tubular rod 30 may protrude outside a distal end of cylinder 15 and a second (e.g., upper) end may be contained within cylinder 15. At a first (lower) end, cylinder 15 includes an end-cap 42 through which the tubular rod 30 may be able to reciprocate. The tubular rod 30 is slidably disposed within cylinder 15 such that extendable portion 20 telescopically extends through the cylinder 15 between a retracted position (e.g., FIG. 2*a*) and an extended position (e.g., FIG. 2*b*).

Referring still to FIG. 2, a sealing assembly 60 comprising seals 62 is shown located on first end of tubular rod 30. The sealing assembly 60 is shaped to fit into a proximal end (e.g., box 3 of FIG. 1) of a string of downhole tubulars 4. The sealing assembly 60 and seals 62 are configured to engage the top end of a string of downhole tubulars 4 when extendable portion 20 is in its extended position, thereby providing a fluidic seal between hydraulic connector 10 (and top-drive assembly 2) and the string of downhole tubulars 4.

Referring again to FIG. 2, the extendable portion 20 includes a cap 40 mounted on second (upper) end of tubular rod 30. As shown, hydraulic connector 10 further includes a piston 50 slidably mounted on tubular rod 30 inside cylinder 15. As shown, piston 50 is free to reciprocate between the cap 40 and the end-cap 42. As such, the inside of the cylinder 15 may be divided by the piston 50 into a first (lower) chamber 80 and a second (upper) chamber 70. The first and second chambers 80 and 70 may be energized with air and drilling mud respectively. First chamber 80 may be in fluid communication with an air supply via a port 92, which may selectively pressurize first chamber 80. Second chamber 70 may be provided with drilling mud from the top-drive 2 via a socket 90, which may (as shown) be a box component of a rotary box-pin threaded connection.

In the disposition of components shown in FIG. 2*a*, the piston 50 and cap 40 are touching, so that drilling mud cannot flow from the second chamber 70 to the string of downhole tubulars 4. FIG. 2*b* shows an alternative position of the cap 40 with respect to piston 50. As shown in FIG. 2*b*, with the cap 40 and piston 50 apart, holes 35 are exposed in the side of the cap 40. These holes 35 provide a fluid communication path between the second chamber 70 and the interior of the tubular rod 30. Thus drilling mud may flow from the second chamber 70 to the string of downhole tubulars 4, via the holes 35 in the cap 40 and the tubular rod 30 when cap 40 is displaced above piston 50.

To extend the extendable portion 20, so that the sealing assembly 60 and seals 62 engage the downhole tubulars 4, the pressure of the fluid in the second chamber 70 of the connector may be increased by allowing flow (e.g. drilling mud) from the top-drive assembly 2. The air in the first chamber 80 may be at a pressure sufficiently high to ensure that the piston 50 abuts the cap 40. As the pressure of the drilling mud increases, the force exerted by the drilling mud on the piston 50 and cap 40 exceeds the force exerted by the air in the first chamber on the piston 50 and the air outside the hydraulic connector 10 acting on the extendable portion 20. The cap 40 may then be forced toward the end-cap 42 and the extendable portion 20 extends. The projected area of the cap 40 may be greater than the projected area of the piston 50 such that the piston 50 remains abutted against cap 40 as the extendable portion extends. Thus, whilst the extendable portion 20 is extending, the holes 35 may not be exposed and drilling mud cannot flow from the top-drive 2 into the string of downhole tubulars 4.

Once the sealing assembly 60 and seals 62 are forced into the open threaded end of the upper end of the string of downhole tubulars 4, thereby forming a fluidic seal between the extendable portion 20 and the open end of the drill string 4, the extendable portion 20, and hence cap 40, are no longer able to extend. In contrast, as the piston 50 is free to move on the tubular rod 30, the piston 50 may be forced further along by the pressure of the drilling mud in the second chamber 70. The holes 35 are thus exposed and drilling mud may be allowed to flow from the second chamber 70, through the extendable portion 20 and into the string of downhole tubulars 4. The pressure of the air in the first chamber 80 may then be released until retraction of the extendable portion 20 is required.

As described above, the hydraulic (e.g., fluidic) connector 10 disclosed in GB2435059 may replace a traditional threaded connection between a top-drive 2 and downhole tubulars 4 during tripping operations of the downhole tubulars 4 into or out of a well.

The hydraulic connector disclosed in GB2435059 may include a pressurised control (e.g., airline) hose connected to the first chamber in order to repeatedly recharge the first chamber with pressurised air in order to retract the extendable portion 20. In certain circumstances it may be desirable to rotate the hydraulic connector, for example to transmit a torque from the top-drive 2 to the downhole tubulars 4 without any hose connections to the first chamber, which may otherwise limit rotation.

Embodiments of the present disclosure seek to address this and other issues.

SUMMARY OF INVENTION

According to a first aspect of the present disclosure there is provided a hydraulic connector to provide a fluidic connection between a fluid supply and a downhole tubular, the connector comprising: a body; an engagement assembly comprising an extendable portion selectively extendable from the body, the engagement assembly being configured to extend and retract a seal assembly disposed at a distal end of the extendable portion into and from a proximal end of the downhole tubular; and a valve assembly operable between an open position and a closed position, the valve assembly being configured to: allow a fluid to communicate between the fluid supply and the downhole tubular through the seal assembly when in the open position; and prevent fluid communication between the fluid supply and the downhole tubular when in the closed position, wherein the extendable portion comprises a first abutment surface disposed to limit the extension of the engagement assembly by contact of the first abutment surface with a corresponding abutment surface of the body.

According to a second aspect of the present disclosure there is provided a hydraulic connector to provide a fluidic connection between a fluid supply and a downhole tubular, the connector comprising: a body; an engagement assembly comprising an extendable portion selectively extendable from the body, the engagement assembly being configured to extend and retract a seal assembly disposed at a distal end of the extendable portion into and from a proximal end of the downhole tubular; and a valve assembly operable between an open position and a closed position, the valve assembly being configured to: allow a fluid to communicate between the fluid supply and the downhole tubular through the seal assembly when in the open position; and prevent fluid communication between the fluid supply and the downhole tubular when in the closed position, wherein the engagement assembly comprises a piston disposed about the extendable portion and configured to divide a cylinder defined by the body portion into a first chamber and a second chamber, the first chamber being configured to contain pressurised fluid to retract the extendable portion, and wherein the first chamber is sealed such that it defines a substantially closed system.

The engagement assembly may comprise a piston, which may be disposed about the extendable portion and divides a cylinder defined by the body portion into a first chamber and a second chamber. The first chamber may contain pressurised fluid to retract the extendable portion. The first chamber may be sealed in normal operation, for example during extension and/or retraction of the extendable portion, to define a substantially closed system. The first chamber may comprise a valve, for example a one-way flow valve, connectable to a source of pressurised fluid, the valve permitting the first chamber to be charged and/or recharged with pressurised fluid. The piston may comprise a third chamber and one or more passages. The one or more passages may fluidicly connect the third chamber to the first chamber.

The engagement assembly may be configured to extend the seal assembly when a pressure of fluids in the fluid supply exceed a threshold value. The second chamber may be in communication with drilling mud to extend the seal assembly.

The extendable portion may comprise a cap. The piston may be configured to be displaced away from the cap when the valve assembly is in the open position. The projected area of the cap exposed to the second chamber and the projected area of the piston exposed to the second chamber may be selected so that the pressure force acting on the cap toward the first chamber may be greater than the pressure force acting on the piston when the extendable portion extends. The projected area of the cap exposed to the second chamber may be greater than the projected area of the piston exposed to the second chamber.

The extendable portion may comprise a through bore extending between the piston and the seal assembly to allow the fluid to communicate between the fluid supply and the downhole tubular. A hole forming part of the flow communication path may be provided in a side-wall of the extendable portion. The hole may be selectively covered by the piston. The hole and piston arrangement may together form the valve assembly.

The piston may be permitted to slide to reveal the holes and open the valve assembly when the first abutment surface on the extendable portion may be in contact the corresponding abutment surface of the body. Alternatively, the piston may be prevented from sliding away from the cap, for example by a further abutment surface provided on an inner wall of the cylinder, when the first abutment surface on the extendable portion may be in contact the corresponding abutment surface of the body, such that the valve assembly may be prevented from opening.

The extendable portion may comprise a second abutment surface disposed to limit the travel of the piston. The piston may be slidably disposed between the cap and the second abutment surface provided on the extendable portion. The extendable portion may comprise an annulet, the annulet forming the first and second abutment surfaces.

The seal assembly may be retractable within the distal end of the body. The seal assembly may be configured to seal against a bore of the downhole tubular beyond a threaded section in the proximal end of the downhole tubular.

The body may comprise a threaded portion disposed at a distal end of the body, the threaded portion being configured to threadably engage a threaded section in the proximal end of the downhole tubular. The threaded portion may threadably engage the downhole tubular inside a box threaded end of the downhole tubular.

The fluid supply may comprise a lifting assembly, for example a top-drive assembly.

According to a third aspect of the present disclosure there is provided a method of providing a fluidic connection between a fluid supply and a downhole tubular using a hydraulic connector, the method comprising: providing the hydraulic connector with a body, a valve assembly, a seal assembly and an engagement assembly, the engagement assembly comprising an extendable portion with the seal assembly disposed upon a distal end of the extendable portion; extending the extendable portion until a first abutment surface disposed on the extendable portion abuts a corresponding abutment surface of the body; engaging the seal assembly within a proximal end of the downhole tubular; opening the valve assembly; and hydraulically communicating fluid between the fluid supply and the downhole tubular.

According to a fourth aspect of the present disclosure there is provided a method of providing a fluidic connection between a fluid supply and a downhole tubular using a hydraulic connector, the method comprising: providing the hydraulic connector with a body, a valve assembly, a seal assembly; and an engagement assembly, the engagement assembly comprising an extendable portion with the seal assembly disposed upon a distal end of the extendable portion; providing the engagement assembly with a piston disposed about the extendable portion and configured to divide a cylinder defined by the body portion into a first chamber and a second chamber; sealing the first chamber such that it defines a substantially closed system; providing the first chamber with pressurised fluid to resist extension of the extendable portion; increasing a pressure of fluids in the fluid supply; extending the extendable portion; resisting movement of the piston tending to reduce the volume of the first chamber; engaging the seal assembly within a proximal end of the downhole tubular; opening the valve assembly; and hydraulically communicating fluids between the fluid supply and the downhole tubular.

The method may further comprise: reducing the pressure of fluids in the fluid supply; closing the valve assembly; and retracting the seal assembly from the proximal end of the downhole tubular. The method may further comprise increasing a pressure of fluids in the fluid supply to extend the extendable portion until a first abutment surface disposed on the extendable portion may abut a corresponding abutment surface of the body.

The method may further comprise: providing the engagement assembly with a piston disposed about the extendable portion and configured to divide a cylinder defined by the body portion into a first chamber and a second chamber; sealing the first chamber during extension and retraction of the extendable portion such that the first chamber defines a substantially closed system; and providing the first chamber with pressurised fluid to resist extension of the extendable portion. The method may further comprise: allowing the pressurised fluid in the first chamber to expand against the piston to retract the extendable portion.

The method may further comprise charging and/or recharging the first chamber with pressurised fluid.

The method may further comprise: providing the extendable portion with a second abutment surface; and limiting the travel of the piston about the extendable portion by contact with the second abutment surface.

Other aspects and advantages of the invention will be apparent from the following description and the appended claims.

BRIEF DESCRIPTION OF DRAWINGS

Features of the present disclosure will become more apparent from the following description in conjunction with the accompanying drawings.

FIG. 2*a* is a sectional side view of the connector with a retracted extendable portion, and FIG. 2*b* is a sectional side view of the connector with an extended extendable portion.

FIG. 3*a* shows the entire connector, whilst FIGS. 3*b* and 3*c* show further details of the valve assembly and seal assembly of the hydraulic connector respectively.

FIG. 4*a* shows the entire connector in an extended position, whilst FIG. 4*b* shows further details of the valve assembly in the closed position. FIG. 4*c* shows the connector engaged with a downhole tubular and the valve assembly in a closed position.

FIG. 5*a* shows the entire connector in an extended position, whilst FIG. 5*b* shows further details of the valve assembly in the open position. FIG. 5*c* shows the connector engaged with the downhole tubular and the valve assembly in an open position.

FIG. 6*a* shows the valve assembly in a closed position and FIG. 6*b* shows the valve assembly in an open position. Both FIGS. 6*a* and 6*b* show the connector engaged with the downhole tubular.

DETAILED DESCRIPTION

Select embodiments describe a tool to direct fluids between a top-drive or other lifting (e.g., including a fluid supply) assembly and a bore of a downhole tubular. In particular, the tool may include an engagement assembly to extend one or more seal assemblies into the bore of one or more downhole tubulars and a valve assembly to selectively allow pressurized fluids from the top-drive assembly to enter the one or more downhole tubular and vice versa.

Figure 1A:
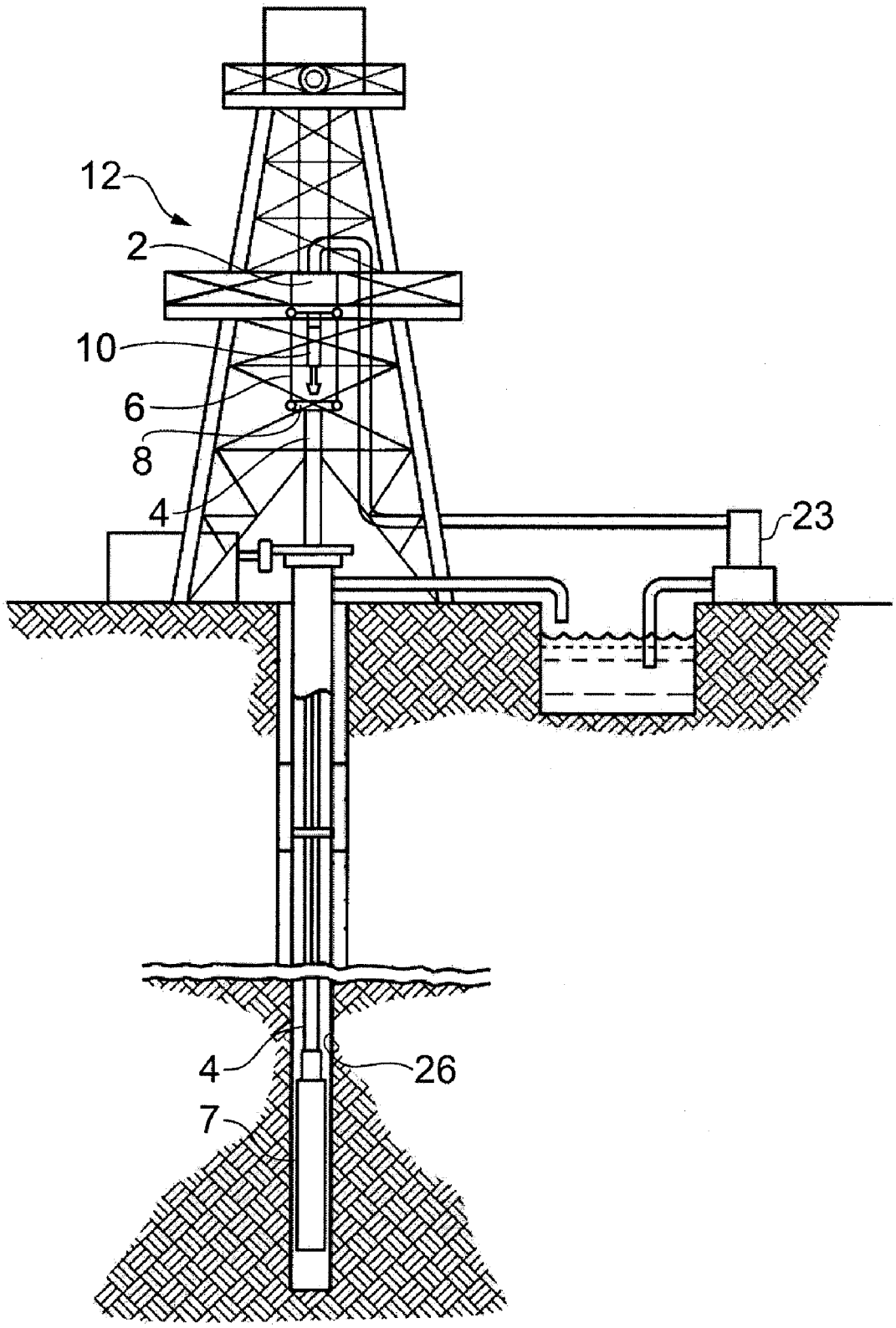
FIGS. 1*a* and 1*b* schematically depict a connector in accordance with embodiments of the present disclosure and depicts the connector in position between a top-drive and a downhole tubular.
Figure 1B:
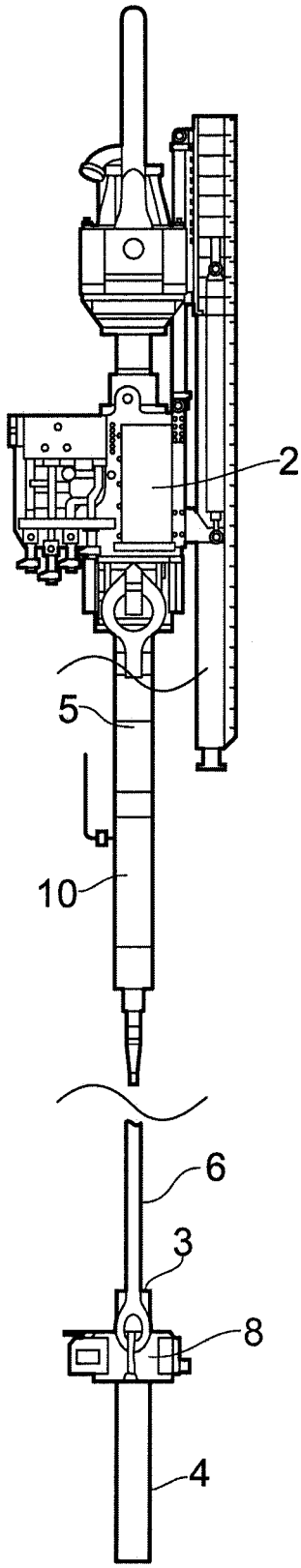
Figure 2A:
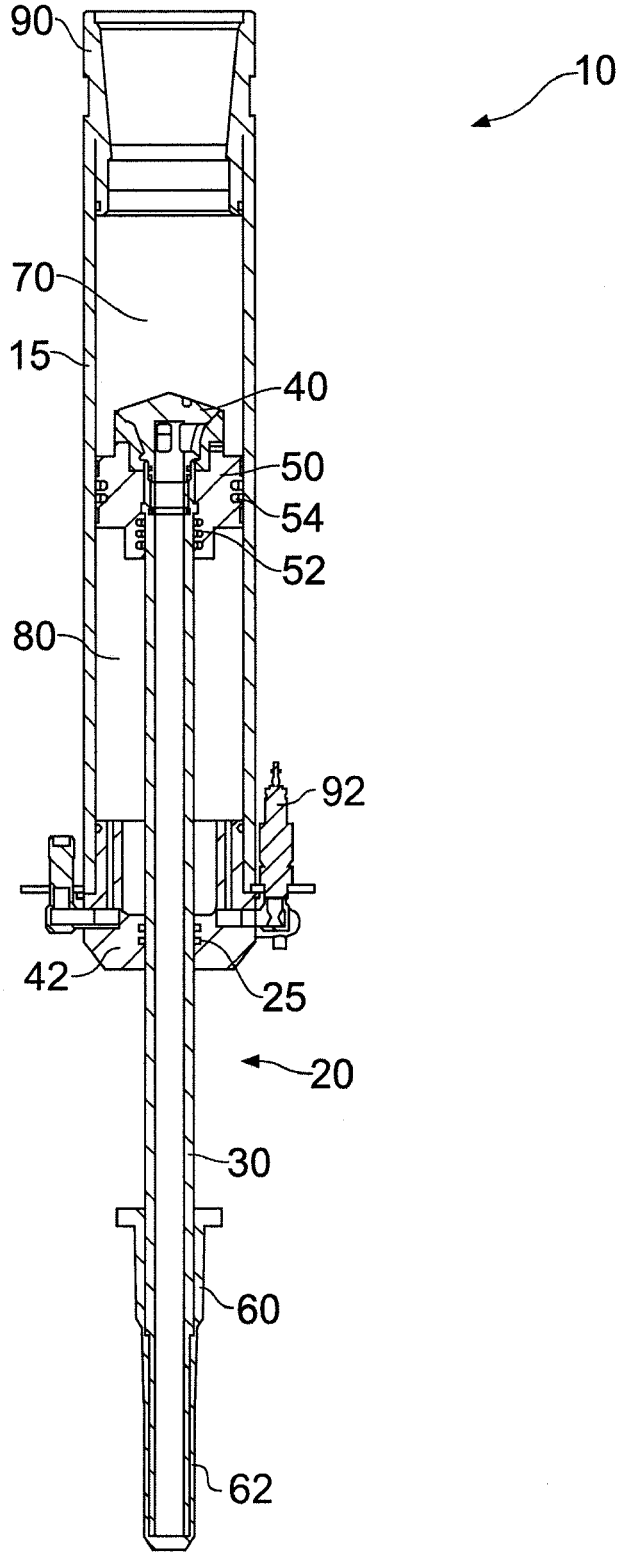
FIGS. 2*a* and 2*b* are side views of the hydraulic connector disclosed in GB2435059.
Figure 2B:
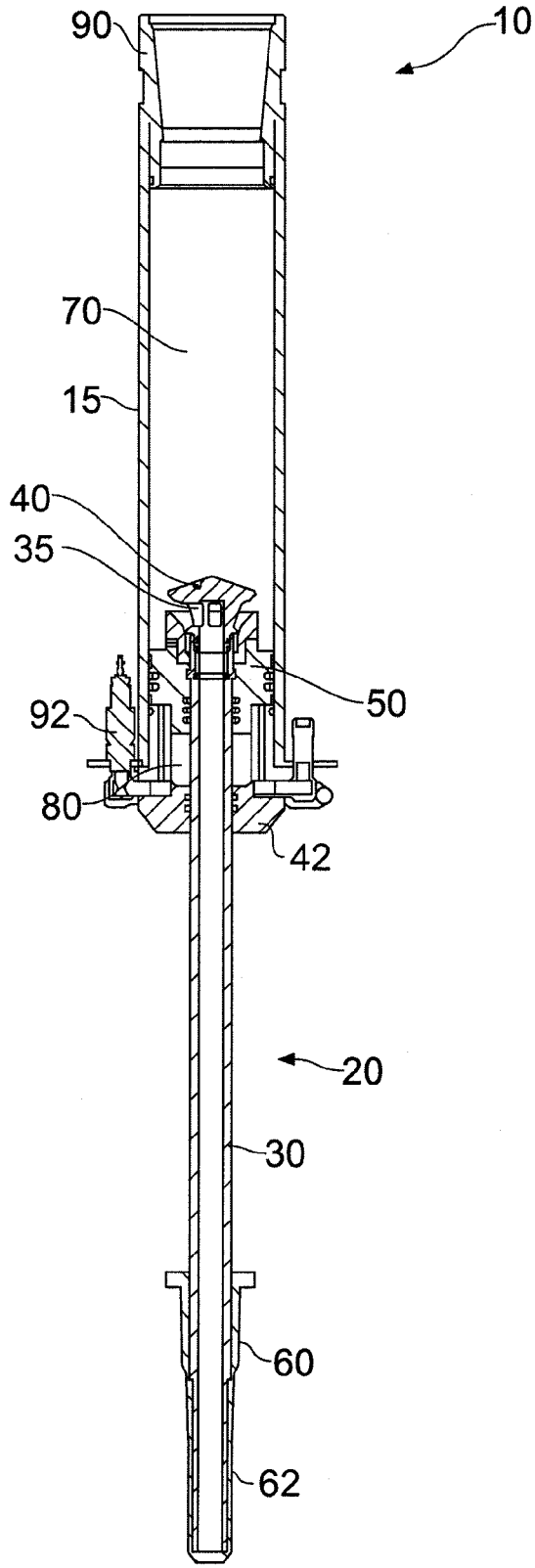

Referring initially to FIGS. 1*a* and 1*b* (collectively referred to as "FIG. 1"), a top-drive assembly 2 is shown connected to a proximal end of a string of downhole tubulars 4. As shown, top-drive 2 may be capable of raising (e.g., "tripping out") or lowering (e.g., "tripping in") downhole tubulars 4 through a pair of lifting bales (e.g., links) 6, each connected between lifting ears of top-drive 2, and lifting ears of an elevator 8. When closed (as shown), elevator 8 grips downhole tubular 4 to support the string, e.g., to prevent the string from sliding further into a wellbore 26 (below).

Thus, the movement of the string of downhole tubulars 4 relative to the wellbore 26 may be restricted to the upward or downward movement of top-drive 2, e.g., via a draw-works/motor movably suspended the top-drive. While top-drive 2 (as shown) may supply any upward force to lift downhole tubular 4, the downward force may be sufficiently supplied by the accumulated weight of the string of downhole tubulars 4, offset by their accumulated buoyancy forces of the downhole tubulars 4 in the fluids contained within the wellbore 26. Thus, as shown, the top-drive assembly 2, lifting bales 6, and elevator 8 may be capable of lifting (and holding) the entire free weight of the string of downhole tubulars 4.

As shown, the string of downhole tubulars 4 may be constructed as a string of threadably connected drill pipes (e.g., a drillstring 4), may be a string of threadably connected casing segments (e.g., a casing string 7), or any other length of generally tubular (or cylindrical) members to be suspended from a rig derrick 12. In a conventional drillstring or casing string, the uppermost section (e.g., the "top" joint) of the string of downhole tubulars 4 may include a female-threaded "box" connection 3. In some applications, the uppermost box connection 3 may be configured to engage a corresponding male-threaded ("pin") connector 5 at a distal end of the top-drive assembly 2 so that drilling-mud or any other fluid (e.g., cement, fracturing fluid, water, etc.) may be pumped through top-drive 2 to bore of downhole tubulars 4. As the downhole tubular 4 is lowered into a well, the uppermost section of downhole tubular 4 may be disconnected from top-drive 2 before a next joint of string of downhole tubulars 4 may be threadably added.

As would be understood by those having ordinary skill, the process by which threaded connections between top-drive 2 and downhole tubular 4 are broken and/or made-up may be time consuming, especially in the context of lowering an entire string (e.g., several hundred joints) of downhole tubulars 4, section-by-section, to a location below the seabed in a deepwater drilling operation. The present disclosure therefore relates to alternative apparatus and methods to establish the connection between the top-drive assembly 2 and the string of downhole tubulars 4 being engaged or withdrawn to and from the wellbore. Embodiments disclosed herein enable the fluid connection between the top-drive 2 (in communication with a mud pump 23) and the string of downhole tubulars 4 to be made using a hydraulic connector tool 10 located between top-drive assembly 2 and the top joint of string of downhole tubulars 4.

However, it should be understood that while a top-drive assembly 2 is shown in conjunction with hydraulic connector 10, in certain embodiments, other types of "lifting assemblies" may be used with hydraulic connector 10 instead. For example, when "running" casing or drill pipe (e.g., downhole tubulars 4) on drilling rigs (e.g., 12) not equipped with a top-drive assembly 2, hydraulic connector 10, elevator 8, and lifting bales 6 may be connected directly to a hook or other lifting mechanism to raise and/or lower the string of downhole tubulars 4 while hydraulically connected to a pressurized fluid source (e.g., a mud pump, a rotating swivel, an IBOP, a TIW valve, an upper length of tubular, etc.). Further still, while some drilling rigs may be equipped with a top-drive assembly 2, the lifting capacity of the lifting ears (or other components) of the top-drive 2 may be insufficient to lift the entire length of string of downhole tubular 4. In particular, for extremely long or heavy-walled tubulars 4, the hook and lifting block of the drilling rig may offer significantly more lifting capacity than the top-drive assembly 4.

Therefore, throughout the present disclosure, where connections between hydraulic connector 10 and top-drive assembly 2 are described, various alternative connections between the hydraulic connector and other, non-top-drive lifting (and fluid communication) components are contemplated as well. Similarly, throughout the present disclosure, where fluid connections between hydraulic connector 10 and top-drive assembly 2 are described, various fluid and/or lifting arrangements are contemplated as well. In particular, while fluids may not physically flow through a particular lifting assembly lifting hydraulic connector 10 and into tubular, fluids may flow through a conduit (e.g., hose, flex-line, pipe, etc) used alongside and in conjunction with the lifting assembly and into hydraulic connector 10.

Figure 3A:
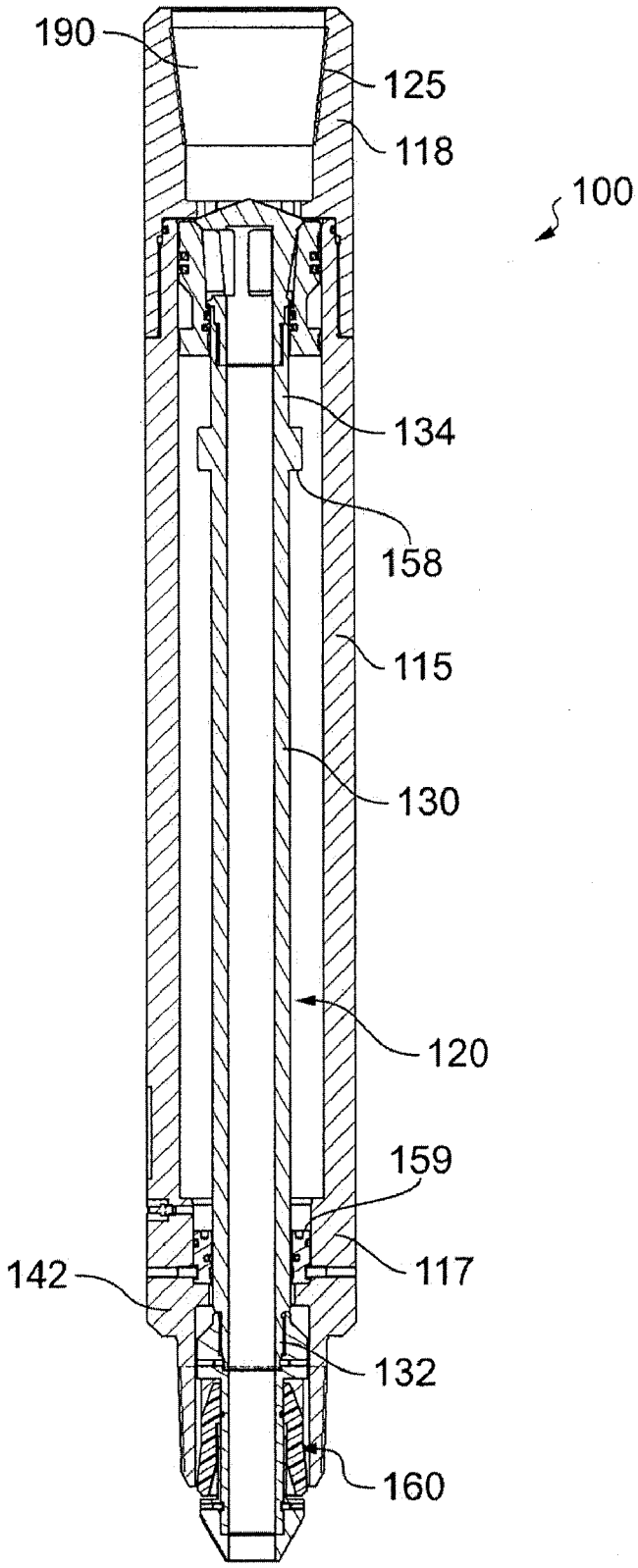
FIGS. 3*a*, 3*b* and 3*c* are sectional side views of a hydraulic connector according to a first embodiment of the present disclosure with the connector in a retracted position and a valve assembly in a closed position.
Figure 3B:
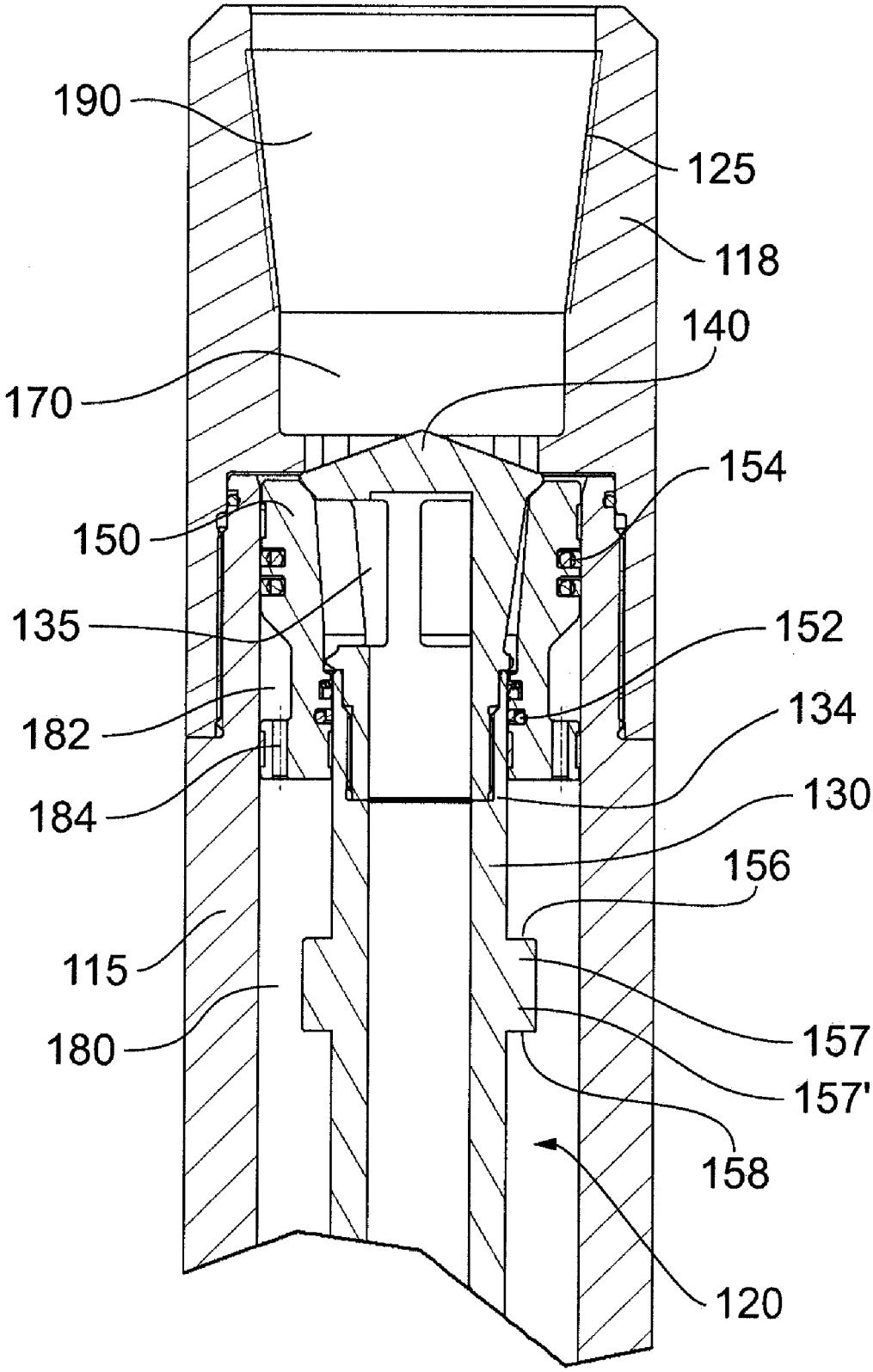
Figure 3C:
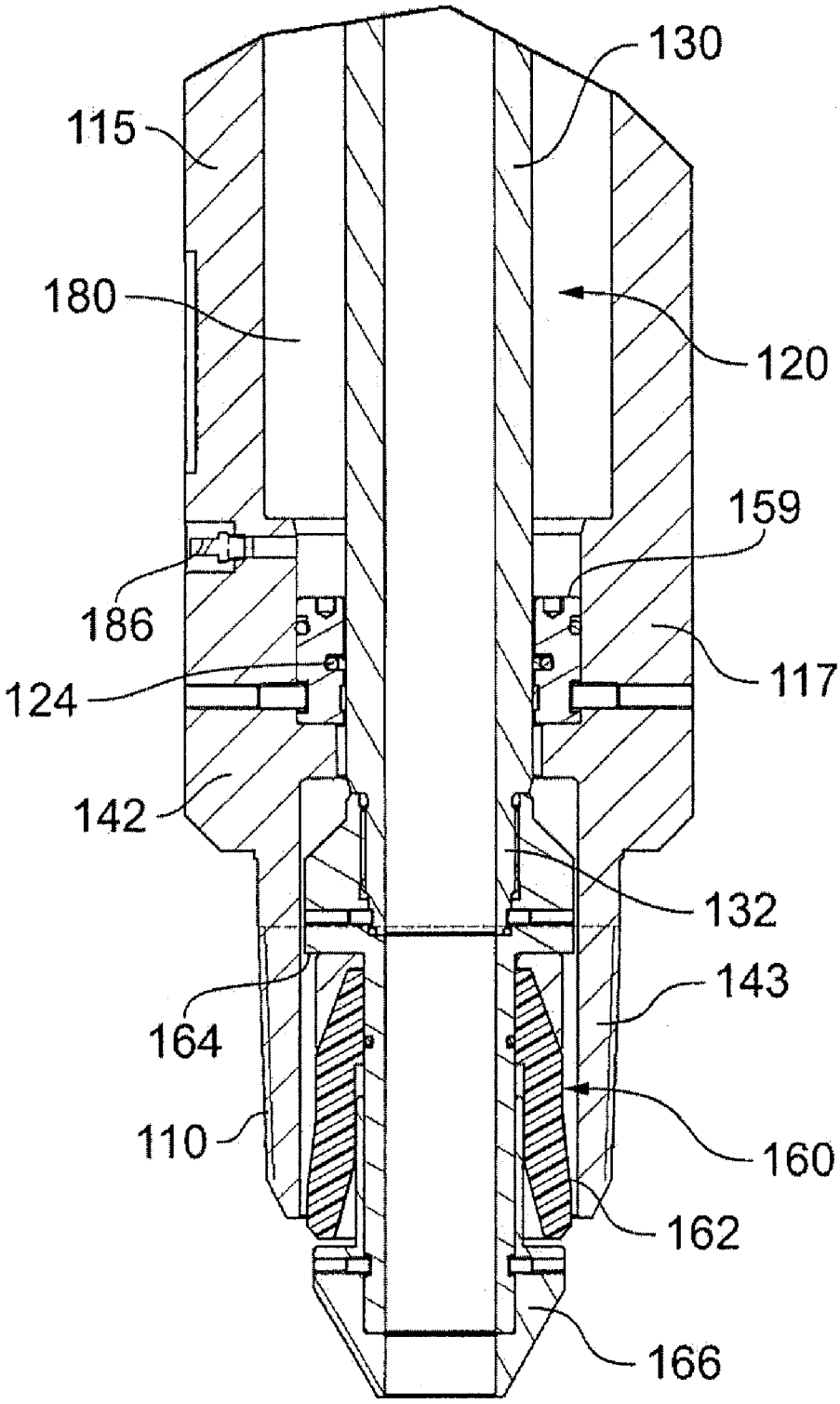

With reference to FIGS. 3*a*, 3*b* and 3*c* (collectively referred to as "FIG. 3"), a hydraulic connector 100 according to a first embodiment of the present disclosure is shown. The hydraulic connector 100 comprises an engagement assembly including a main or primary cylinder 115 and an extendable portion 120 slidably engaged and configured to reciprocate within cylinder 115. As shown, extendable portion 120 includes a hollow tubular rod 130 configured to be slidably engageable within cylinder 115 so that a first (lower) end 132 of tubular rod 130 may protrude outside a distal end of cylinder 115 and a second (upper) end 134 may be contained within cylinder 115. Tubular rod 130 and cylinder 115 may be arranged such that their longitudinal axes are coincident and tubular rod 130 may be slidably disposed within cylinder 115 such that extendable portion 120 may telescopically extend through the cylinder 115 between at least one a retracted position (e.g., FIG. 3) and at least one extended position (e.g., FIG. 4).

At the lower end 132 of the tubular rod 130, there may be provided a sealing assembly 160. The sealing assembly may be adapted to selectively provide a seal with the string of downhole tubulars 4. The string of downhole tubulars 4 may comprise a drill pipe string, a casing string or a drill pipe string connected to a casing string.

At a first (lower) end 117, cylinder 115 may include an end plug 142 through which the tubular rod 130 may be able to reciprocate. The end plug 142 may be integral with the cylinder 115 (as shown in FIG. 3) or may be configured to be threaded into distal end 117 of cylinder 115, although those having ordinary skill will appreciate that other connection mechanisms may be used.

At the upper end 118 of cylinder 115, a socket 190 (e.g., box) with a threaded connection 125 may be provided for engagement with a fluid source, e.g., the bore of the quill of a top-drive assembly 2 connected to a mud tank via mud pump(s). As shown, threaded connection 125 may include a standard threaded female box connection which may be configured to threadably engage a corresponding pin thread of top-drive assembly 2. Therefore, as shown, top-drive assembly 2 may provide drilling fluid to cylinder 115 through threaded connection 125.

Referring to FIG. 3*b*, the extendable portion 120 may include a cap 140 mounted on second (upper) end 134 of tubular rod 130. As shown, hydraulic connector 100 further includes a piston 150 slidably mounted on tubular rod 130 inside cylinder 115. Additionally, in certain embodiments, piston 150 may also be capable of rotating about its centre axis with respect to cylinder 115. Furthermore, the entire assembly (120, 140, 150 and 160) may be able to slide (and/or rotate) with respect to cylinder 115. As such, the inside of the cylinder 115 may be divided by the piston 150 into a first (lower) chamber 180 and a second (upper) chamber 170. When viewed in a downward direction from above (e.g., from the top-drive as depicted), the projected area of the piston 150 may be less than the projected area of the cap 140 such that when the piston 150 abuts the cap 140, the pressure force from the fluid in the second chamber 170 acting on the cap 140 may be greater than that acting on the piston 150.

Second chamber 170 may be selectively energised with drilling mud from the top-drive 2 via the socket 190 and operation of the mud pumps 23. First chamber 180 may contain a pressurised first fluid, e.g., air, nitrogen, water, drilling mud, or hydraulic fluid. The piston 150 may be sealed against the tubular rod 130 and cylinder 115, for example, by means of o-ring seals 152 and 154 respectively, to prevent fluid communication between the two chambers 170 and 180. Furthermore, first chamber 180 may be sealed from the second chamber 170 and from outside the hydraulic connector 100 such that the first chamber 180 may define a substantially closed system, e.g., the first fluid held in the first chamber may be substantially prevented from escaping and the first chamber 180 may comprise a substantially constant mass of the first fluid. As such, the volume of the first chamber 180 depends on the position of the piston 150 and the pressure of the first fluid held in the first chamber 180 varies accordingly.

One or more holes 135 may be provided at the second end 135 of the tubular rod 130. Furthermore, the holes 135 may be provided on a sidewall of the tubular rod 130 and may be adjacent to the cap 140. Holes 135 may selectively permit fluid to flow from the second chamber 170 to the centre of the hollow tubular rod 130 and subsequently to the string of downhole tubulars 4. However, in the disposition of components shown in FIG. 3*b*, the piston 150 and cap 140 are touching and the holes 135 are blocked by the piston 150, so that drilling mud cannot flow from the second chamber 170 to the string of downhole tubulars 4.

Referring again to FIG. 3*b*, the piston 150 may comprise a piston chamber 182. The piston chamber 182 may be formed by an opening within the piston 150 and a perimeter of the piston chamber 182 may be partially defined by an inner surface of the cylinder 115. Piston 150 may further comprise one or more passages 184 such that the piston chamber 182 may form part of the first chamber 180. The passages 184 may be distributed about the perimeter of a lower surface of the piston 150. The passages 184 may fluidicly connect the piston chamber 182 to the remainder of the first chamber 180. Accordingly, the piston chamber 182 increases the volume of the first chamber 180 which may in turn reduce the maximum pressure of the first fluid in the first chamber 180 for example when the piston 150 and tubular rod 130 have moved towards the end plug 142 (as is shown in FIG. 4).

The extendable portion 120 may comprise a first abutment surface 158 provided on the tubular rod 130. The first abutment surface 158 may be disposed such that it limits the travel of the tubular rod 130 towards the end plug 142 (as is shown in FIG. 4). The first abutment surface 158 may abut a corresponding abutment surface 159 provided on the end plug 142. The first abutment surface 158 may be formed by a shoulder of a protrusion 157', for example an annulet or a ring, disposed about the tubular rod 130. Furthermore, the extendable portion 120 may comprise a second abutment surface 156 provided on the tubular rod 130. The second abutment surface 156 may be disposed such that the piston 150 may be free to move between the cap 140 and the second abutment surface 156. The second abutment surface 156 may be formed by a shoulder of a protrusion 157, for example an annulet or a ring, disposed about the tubular rod 130. As shown, the protrusions 157', 157 forming the first and second abutment surfaces may be unitary, or in an alternative embodiment (not shown) the protrusions 157', 157 forming the first and second abutment surfaces may be spaced apart and distinct from one another.

Referring to FIG. 3*c*, the sealing assembly 160 comprises a seal 162 located on first end 132 of tubular rod 130. The seal 162 may be selected and/or adapted to selectively provide a seal with downhole tubular 4, for example, to seal against a bore of downhole tubular 4. In particular, the seal 162 may seal against the bore of downhole tubular 4 at a point below the box 3 (as shown in FIG. 4*c*). The seal 162 may comprise a resilient material, for example rubber, and the seal may comprise a cup seal.

While seal 162 is shown to be a particular configuration (e.g., a cup seal), it should be understood that seal 162 may be of any type known by those having ordinary skill to effectively seal with a variety of types of downhole tubulars 4. Furthermore, in certain embodiments, sealing assembly 160 (and seal 162) may be made from a resilient and/or elastomeric material (e.g., rubber, nylon, polyethylene, silicone, etc.) and may be shaped to fit into a proximal end (e.g., into the bore of downhole tubular 4 at a point below the box 3 of FIG. 1) of string of downhole tubulars 4. Similarly, sealing assembly 160 may be configured to seal atop or around proximal end of downhole tubulars 4.

Referring still to FIG. 3*c*, the seal assembly 160 may further comprise a seal shoulder 164. The seal shoulder 164 may protrude beyond the outer diameter of the seal 162 and the seal shoulder 164 may be adapted to abut a shoulder within the box 3 of a downhole tubular 4 (as shown in FIG. 4*c* referred to below). The seal shoulder 164 may prevent the extendable portion 120 from extending further into the downhole tubular 4. In an alternative arrangement, the seal shoulder 164 may be omitted and the extendable portion 120 and seal 162 may be permitted to extend further into the bore of the downhole tubular 4. In such an alternative arrangement, the extendable portion 120 may extend until the first abutment surface 158 abuts abutment surface 159 of the end plug 142. The seal 162 may therefore seal against a portion of the bore of the downhole tubular, e.g., below that shown in FIG. 4*c*. However, the inner diameter of the bore of the downhole tubular may not be constant and it may increase further away from the box 3. The seal 162 may not provide an effective seal if sealing against a larger internal diameter portion of the bore. Therefore, it may be desirable to provide the seal assembly 160 with the seal shoulder 164 to ensure that the seal 162 seals against the same portion of the bore. Accordingly, the seal 164 may be sized appropriately for the portion of the bore just below the box 3 in order to provide an effective seal.

The extendable portion 120 may further comprise a centralising member 166 (e.g., nose cone) provided on a distal end of the tubular rod 130. The centralising member 166 may be disposed so as to centralise the extendable portion 120 with respect to the bore of the downhole tubular 4 below the box connection as the hydraulic connector 100 is brought into engagement with the downhole tubular. For example, the centralising member 166 may assist in ensuring that the downhole tubular connector 100 may be substantially laterally aligned with the bore of the downhole tubular 4. The centralising action of the centralising member 166 may be by virtue of its shape and dimensions. For example, the centralising member 166 may be frustoconical in shape. Accordingly, a distal end of the centralising member 166 may have an outer diameter which may be less than the inner diameter of the bore of the downhole tubular 4 below the box connection. The opposite end of the centralising member 166, e.g. that nearest the seal 162, may have an outer diameter which may be less than the inner diameter of the bore of the downhole tubular below the box connection. However, the outer diameter of the opposite end of the centralising member 166 may be sufficiently close in size to the inner diameter of the bore of the downhole tubular 4 below the box connection, such that the centralising member 166 may perform its centralising function, e.g. that it limits lateral movement of the extendable portion 120. Furthermore, the opposite end of the centralising member 166 may have an outer diameter which may also be less than the outermost diameter of the seal 162 such the seal may contact the inner diameter of the bore of the downhole tubular 4 below the box connection.

The first chamber 180 may be filled and pressurised via a valve 186, which may for example comprise a one-way flow (or check) valve. Accordingly, the first valve 186 may prevent first fluid from escaping the first chamber 180. Furthermore, the valve 186 may permit the first chamber 180 to be initially pressurised and/or recharged if there is any leakage from the first chamber 180.

Referring still to FIG. 3*c*, a threaded portion 110 comprising an outwardly-facing threaded section may be provided on a distal portion 143 of end plug 142. Threaded portion 110 may be integral with the end plug 142 or may be connected to end plug 142 by virtue of a threaded connection. As shown, threaded portion 110 includes a passage and a bore to allow tubular rod 130 to pass therethrough as hydraulic connector 100 reciprocates between extended retracted positions. In select embodiments, end plug 142 may be configured to seal the inside of cylinder 115 from outside and to allow tubular rod 130 to slide in or out of the cylinder 115. As would be understood by those having ordinary skill, seals, (e.g., o-rings) 124 may be used to seal between end plug 142 and tubular rod 130.

As is shown in FIG. 3*c*, the seal 162 may be located inside the end plug 142 when the extendable portion 120 is in the retracted position, such that the seal 162 may be protected by the end plug 142. In particular, the seal 162 may be located within the portion 143 of the end plug 142 comprising the threaded portion 110. Accordingly, the maximum outer diameter of the sealing assembly 160 may be less than the internal diameter of the portion 143 of the end plug 142 comprising the threaded portion 110. By contrast, the centralising member 166 may be proud of the threaded portion 110 when the extendable portion 120 is in the retracted position.

In one mode of operation, the threaded portion 110 may be threadably connected to an open end (e.g., a "box" end) of downhole tubulars 4. The hydraulic connector 100 may therefore be used to transmit torque from the top-drive 2 (e.g., the quill thereof) to the downhole tubulars 4. Accordingly, in order to transmit drive, the threaded connections between the top-drive 2, threaded portion 110 and downhole tubulars 4 may be orientated in the same direction. The threaded portion 110 may also be adapted to connect to other tools, such as a cementing tool. In a further mode of operation, both the threaded portion 110 and sealing assembly 160 may be connected to the downhole tubular 4. For example, the threaded portion 110 may be threadably connected to the open end (e.g., a "box" end) of downhole tubulars 4 and the sealing assembly 160 may be extended such that it may be in sealing engagement with the bore of downhole tubulars 4 below the box connection 3.

Figure 4A:
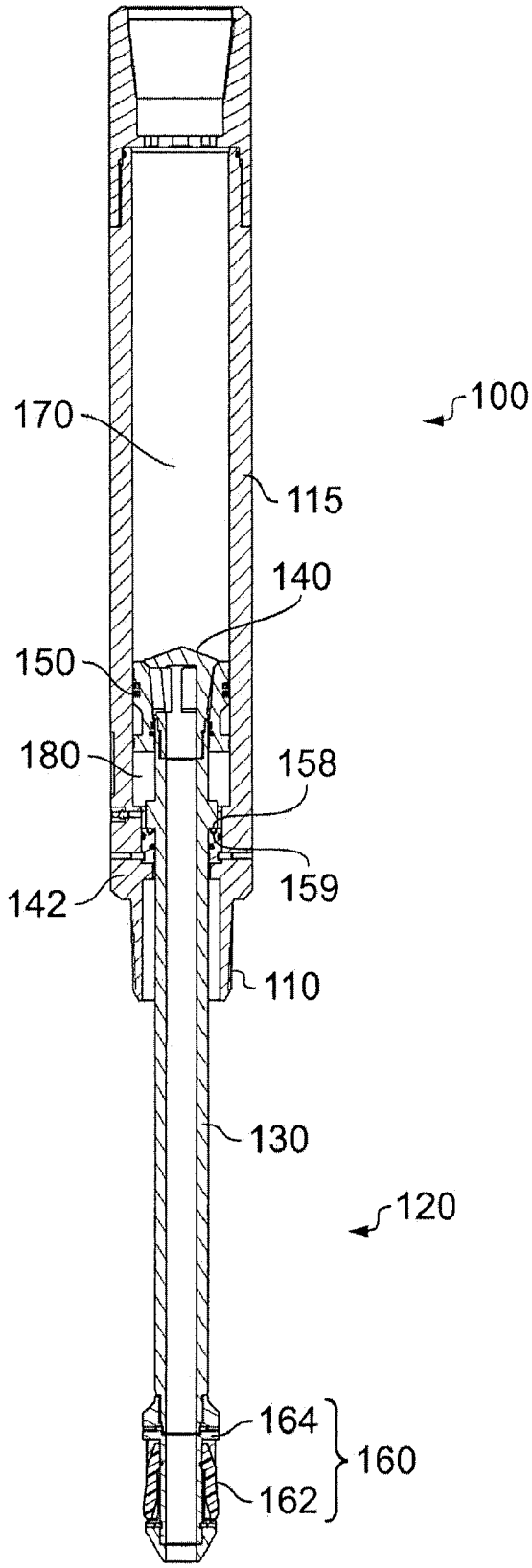
FIGS. 4*a*, 4*b* and 4*c* are further sectional side views of the hydraulic connector according to a first embodiment of the present disclosure with the connector in an extended position and the valve assembly in a closed position.
Figure 4B:
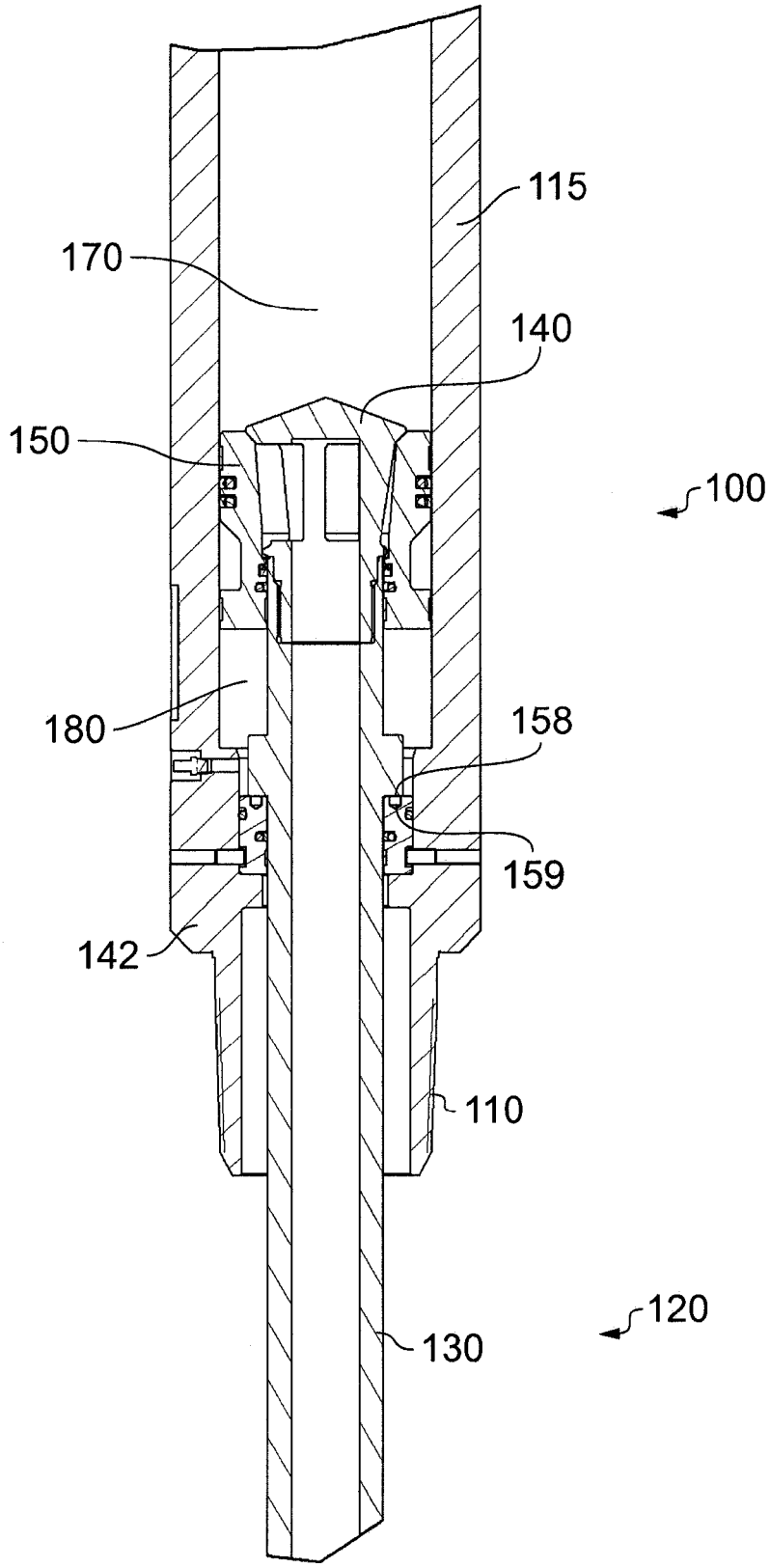
Figure 4C:
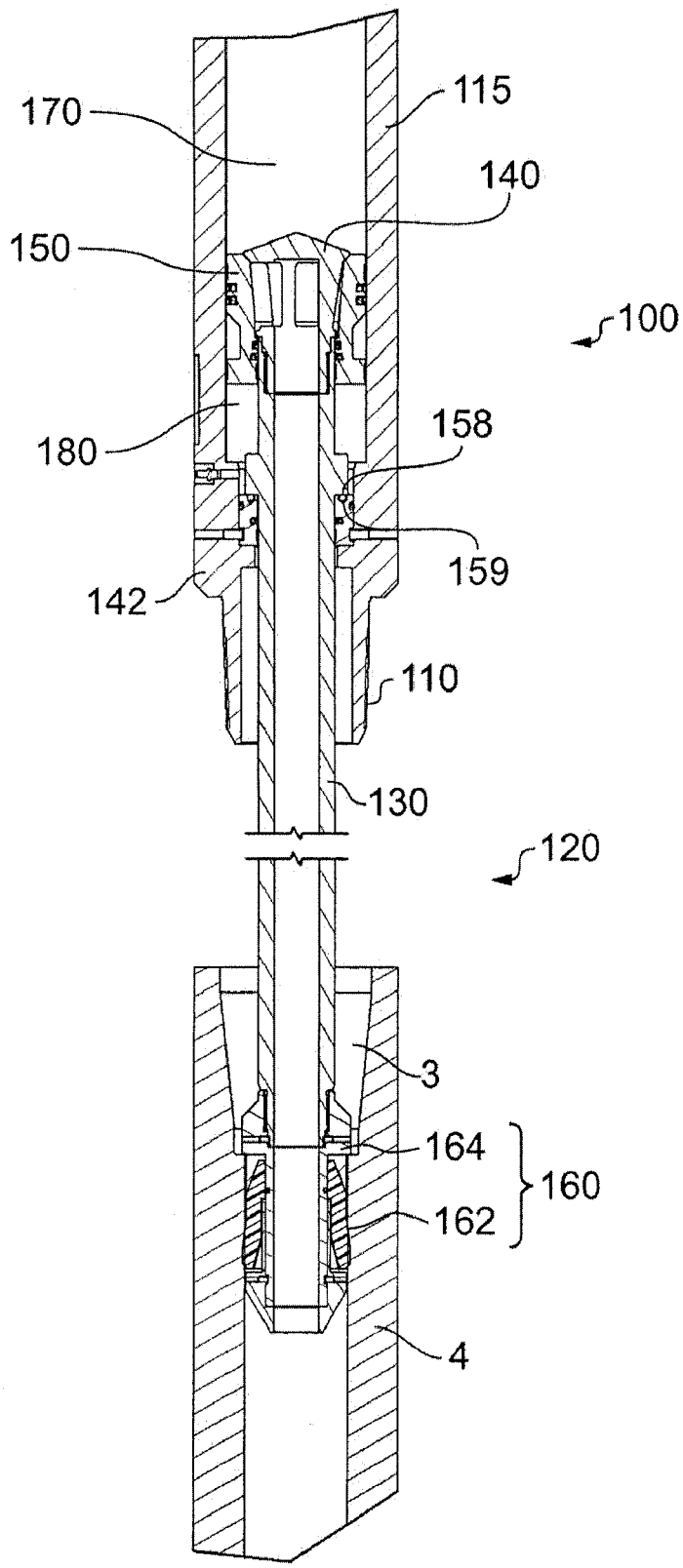

With reference to FIGS. 4*a*, 4*b* and 4*c* (collectively referred to as "FIG. 4"), the hydraulic connector 100 in the extended and closed position is shown. To extend the extendable portion 120, so that the sealing assembly 160 and seals 162 engage the downhole tubulars 4, the pressure of the fluid in the second chamber 170 of the connector may be increased by allowing flow (e.g. drilling mud) from the top-drive assembly 2 (e.g. by turning on the top-drive assembly mud pumps 23). The first fluid in the first chamber 180 may be at a pressure sufficiently high to ensure that the piston 150 abuts the cap 140. As the pressure of the drilling mud increases, the force exerted by the drilling mud on the piston 150 and cap 140 exceeds the force exerted by the first fluid in the first chamber on the piston 150 and the air outside the hydraulic connector 100 acting on the extendable portion 120. The cap 140 may then be forced toward the end plug 142 and the extendable portion 120 extends. As the projected area of the cap 140 may be greater than the projected area of the piston 150 and the pressure in the first chamber 180 may only be exposed to the piston 150, the piston 150 may remain abutted against cap 140. Thus, whilst the extendable portion 120 is extending, the holes 135 may not be exposed and drilling mud may not flow from the top-drive 2 into the string of downhole tubulars 4.

Referring still to FIG. 4, the extendable portion 120 may extend until the first abutment surface 158 provided on the tubular rod 130 abuts the corresponding abutment surface 159 provided on the end plug 142. At this maximum stroke of the extendable portion 120, the cylinder 115 and end plug 142 are arranged such that the piston 150 may still slide about the tubular rod 130 and that the holes 135 may be opened.

The first chamber 180 may be a closed system which does not permit the removal or addition of first fluid into or from the first chamber during repeated extension or retraction of the extendable portion 120. As a result, when the extendable portion 120 extends, the volume of the first chamber 180 may decrease and the pressure in the first chamber may increase accordingly. It may therefore become increasingly hard to further compress the first fluid in the first chamber and lower the extendable portion 120 and/or piston 150. However, the interaction of the first and corresponding abutment shoulders 158, 159 may ensure that the first chamber 180 maintains a minimum volume when the extendable portion 120 is at maximum stroke. As there may be a fixed quantity, e.g. mass, of first fluid in the first chamber 180, the maximum pressure in the first chamber 180 may be limited. This maximum pressure may in turn permit the first fluid contained within the first chamber to be further compressed (for example to lower the piston 150). Furthermore, the presence of the piston chamber 182, which may form part of the first chamber 180, may also ensure that the first chamber 180 has a minimum volume and that the pressure in the first chamber may be prevented from becoming undesirably high, e.g. for the seals 154 to ensure containment of the first fluid in the first chamber 180.

In addition, cyclically compressing and decompressing the first fluid within the first chamber 180 allows there to be no hoses connected to the hydraulic connector 100 during repeated extension or retraction of the extendable portion 120. The hydraulic connector 100 may therefore be more readily rotated, for example by the top drive 2, without having to disconnect any hoses from the tool and/or use a fluidic swivel. Nevertheless, in the case of any fluid pressure changes desired in the first chamber 180, hoses may be connected to the tool via valve 186 to change the pressure in the first chamber 180. The first chamber 180 may also be initially charged with hoses temporarily connected to valve 186.

As shown in FIG. 4*c*, the sealing assembly 160 and seals 162 may be configured to engage the top end of the string of downhole tubulars 4 when extendable portion 120 is in its extended position, thereby providing a fluidic seal between hydraulic connector 100 (and top-drive assembly 2) and the string of downhole tubulars 4. The seal 162 may seal against the bore of downhole tubular 4 at a point below the box 3 and the seal shoulder 164 may be adapted to abut a shoulder within the box 3 of the downhole tubular 4. Thus, in select embodiments, the seals 162 effectuate a seal between an inner bore of downhole tubular 4 and an outer profile of tubular rod 130. Furthermore, in select embodiments, sealing assembly 160 and/or seals 162 may seal on, in, or around box 3 in the top joint of string of downhole tubulars 4.

Figure 5A:
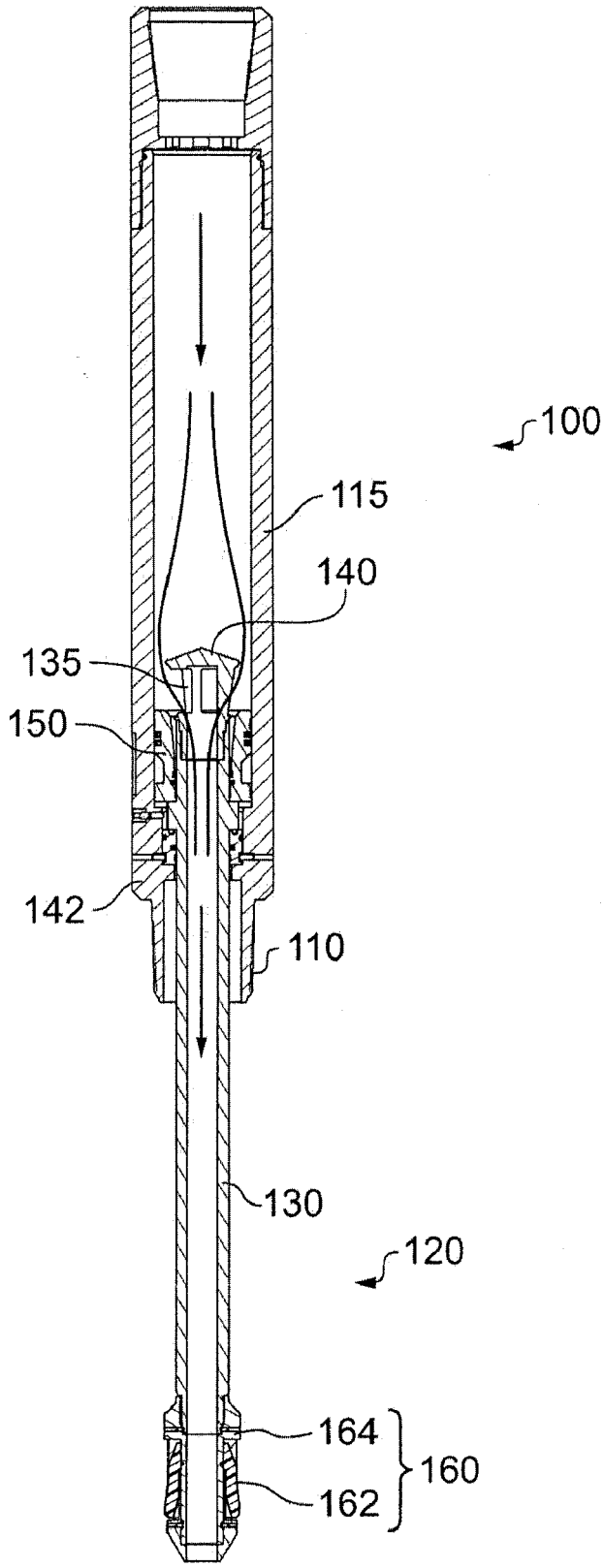
FIGS. 5*a*, 5*b* and 5*c* are further sectional side views of the hydraulic connector according to a first embodiment of the present disclosure with the connector in a fully extended position and the valve assembly in an open position.
Figure 5B:
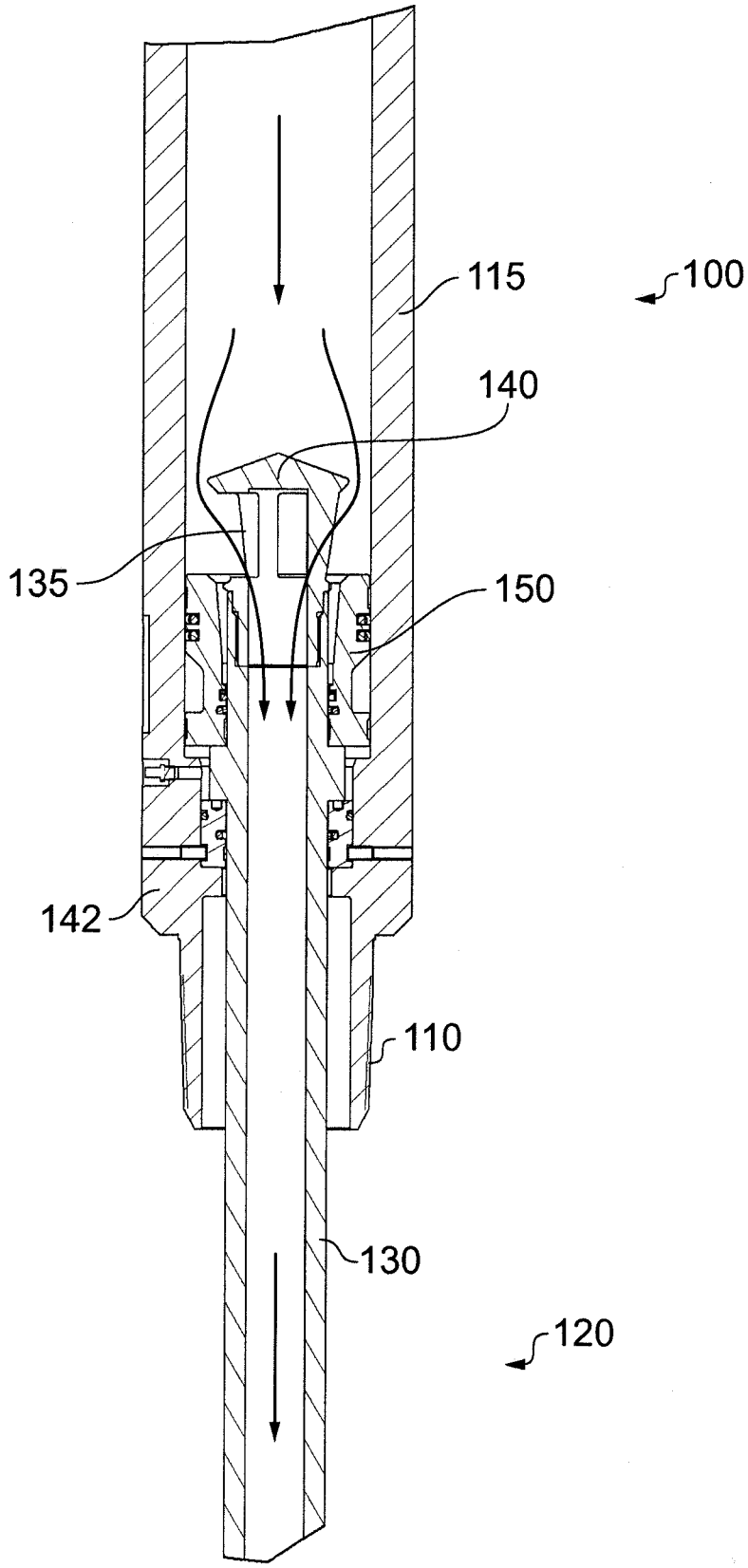
Figure 5C:
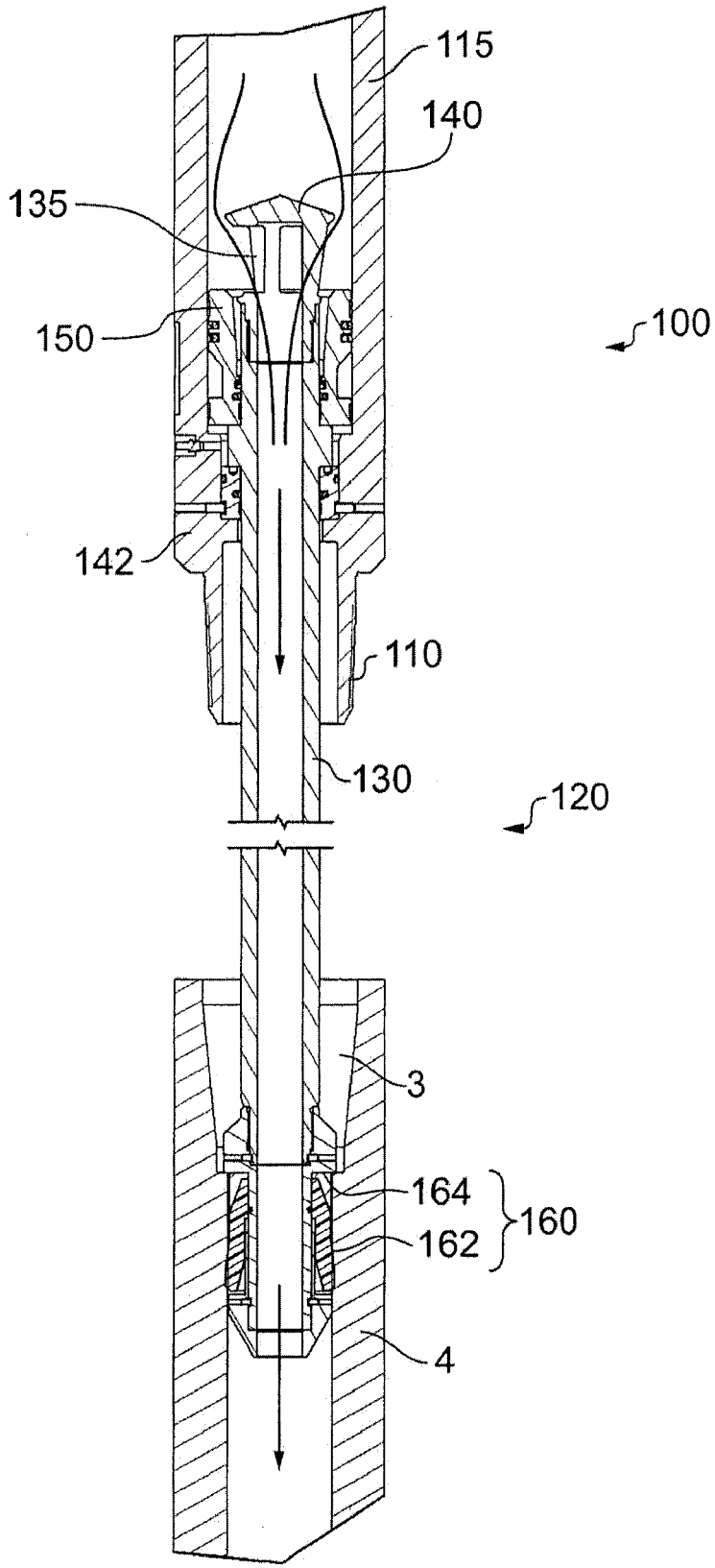

With reference to FIGS. 5*a*, 5*b* and 5*c* (collectively referred to as "FIG. 5"), an alternative position of the cap 140 with respect to piston 150 is shown. Once the sealing assembly 160 and seals 162 are forced into the open end of the upper end of the string of downhole tubulars 4, thereby forming a fluidic seal between the extendable portion 120 and the open end of the drill string 4, the extendable portion 120, and hence cap 140, are no longer able to extend. In contrast, as the piston 150 may be free to move on the tubular rod 130, the piston 150 may be forced further along by the pressure of the drilling mud in the second chamber 170. The pressure of the drilling mud may be sufficient to overcome the pressure of first fluid in the first chamber 180 so that there may be a net downwards force acting on the piston 150 causing it to lower. The holes 135 are thus exposed and drilling mud may be allowed to flow from the second chamber 170, through the extendable portion 120 and into the string of downhole tubulars 4.

As shown, with the cap 140 and piston 150 apart, holes 135 are exposed in the side of the cap 140. As indicated by the arrows, these holes 135 provide a fluid communication path between the second chamber 170 and the interior of the tubular rod 130. Thus drilling mud may flow from the second chamber 170 to the string of downhole tubulars 4, via the holes 135 in the cap 140 and the tubular rod 130 when piston 150 may be displaced below cap 140.

The travel of the piston 150 may be limited by the second abutment shoulder 156. Thus, once the extendable portion 120 has landed in the downhole tubular 4 and the pressure force acting on the piston 150 from the second chamber may be sufficient to overcome the opposing pressure force from the first chamber, the piston 150 may abut the second abutment shoulder 156, and expose the holes 135. The abutment of the piston 150 against the second abutment shoulder 156 may be advantageous because it may increase the area over which the pressure in the second chamber 170 acts. Because of the second abutment shoulder 156, the pressure force acting on the piston 150 from the second chamber may contribute to the net pressure force acting on the extendable portion 120. This additional pressure force may assist in maintaining the extendable portion 120 in engagement with the downhole tubular 4.

With the holes 135 open, the hydraulic connector 100 will allow the volume displaced by the removal of the string of downhole tubulars 4 from the well to be replaced by drilling mud. Alternatively, if the string of downhole tubulars 4 is to be lowered into the well while attached to the hydraulic connector 100, then the string of downhole tubulars 4 may displace fluid within the well and result in a back-flow into the hydraulic connector 100 and top-drive 2.

When the extendable portion 120 is to be retracted from the downhole tubulars 4, the top-drive's fluid pumps may be stopped to reduce the pressure of the fluid in the second chamber 170. The force exerted on the piston 150 by the fluid in the second chamber 170 may then be less than the force exerted on the piston 150 by the pressurised first fluid in the first chamber 180 and the piston 150 may be biased towards the cap 140 and socket 190. Retraction of the piston 150, in turn, forces the retraction of the extendable portion 120 into the cylinder 115. The piston 150 may also abut the cap 140, thereby closing the holes 135 and thereby limiting any spillage by ensuring no fluid (e.g. drilling mud) flows out of the hydraulic connector. When the extendable portion 120 is retracted, the sealing assembly 160 and the seals 162 may be disengaged from the downhole tubulars 4. The topmost section of the downhole tubulars 4 may then be removed or added to if desired.

Figure 6A:
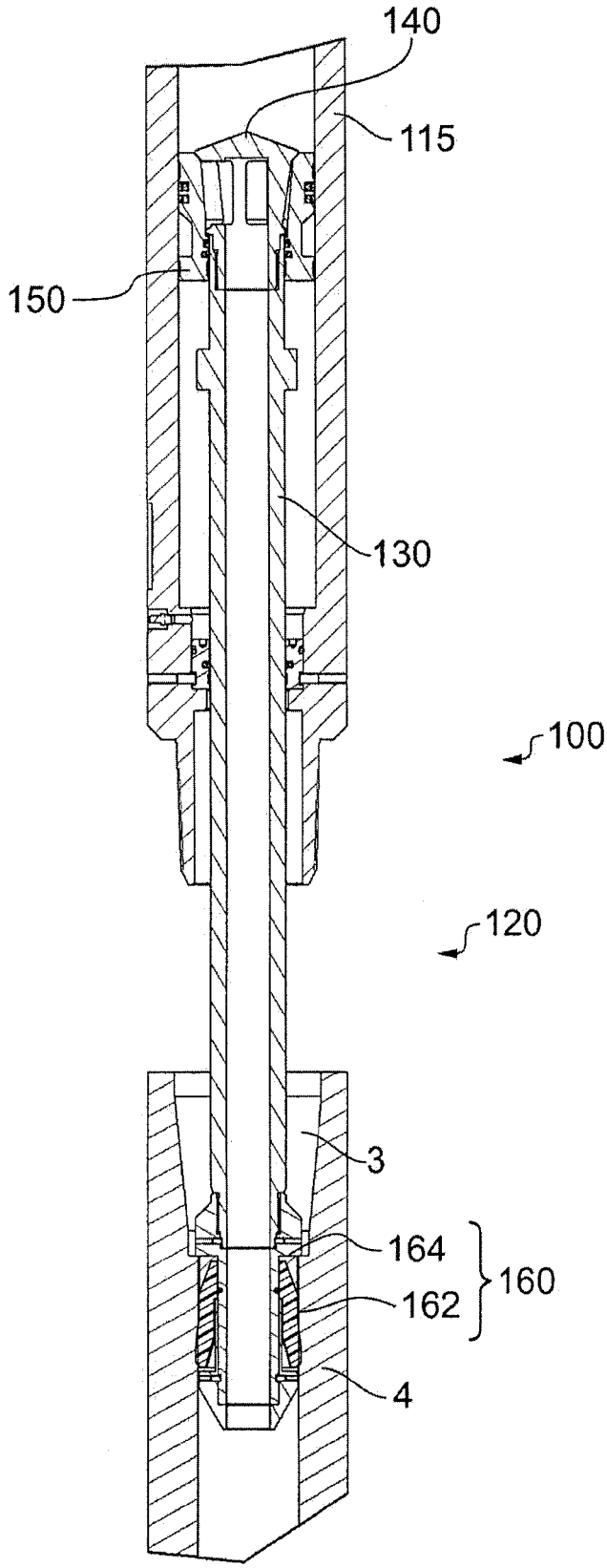
FIGS. 6*a* and 6*b* are further sectional side views of the hydraulic connector according to a first embodiment of the present disclosure with the connector in a partially extended position and the valve assembly in an open position.
Figure 6B:
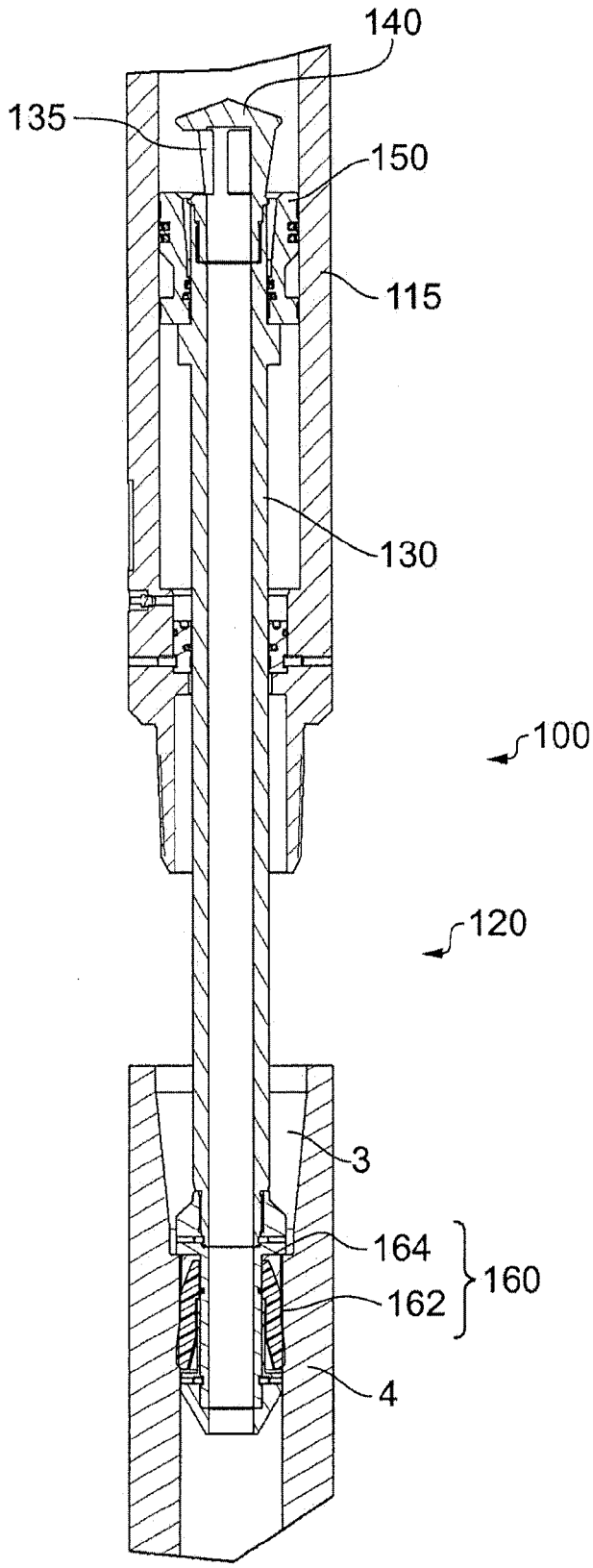

With reference to FIGS. 6*a* and 6*b* (collectively referred to as "FIG. 6"), the extendable portion 120 may engage the downhole tubular 4 when the extendable portion is in a partially extended position, e.g. before the first abutment surface 158 provided on the tubular rod 130 abuts the corresponding abutment surface 159 provided on the end plug 142. Further extension of the extendable portion 120 may be prevented by the seal shoulder 164 abutting the shoulder within the box 3 of the downhole tubular 4. As shown in FIG. 6*b*, once the extendable portion 120 has engaged the downhole tubular 4, the piston 150 may slide with respect to cap 140 to reveal the holes 135 and permit flow through the connector 100 in the same way as described above. As a result, the downhole tubulars 4 may be held relative to the top drive 2 by bales 6 at a distance from the hydraulic connector 100 less than the maximum stroke shown in FIGS. 4 and 5.

Figure 7:
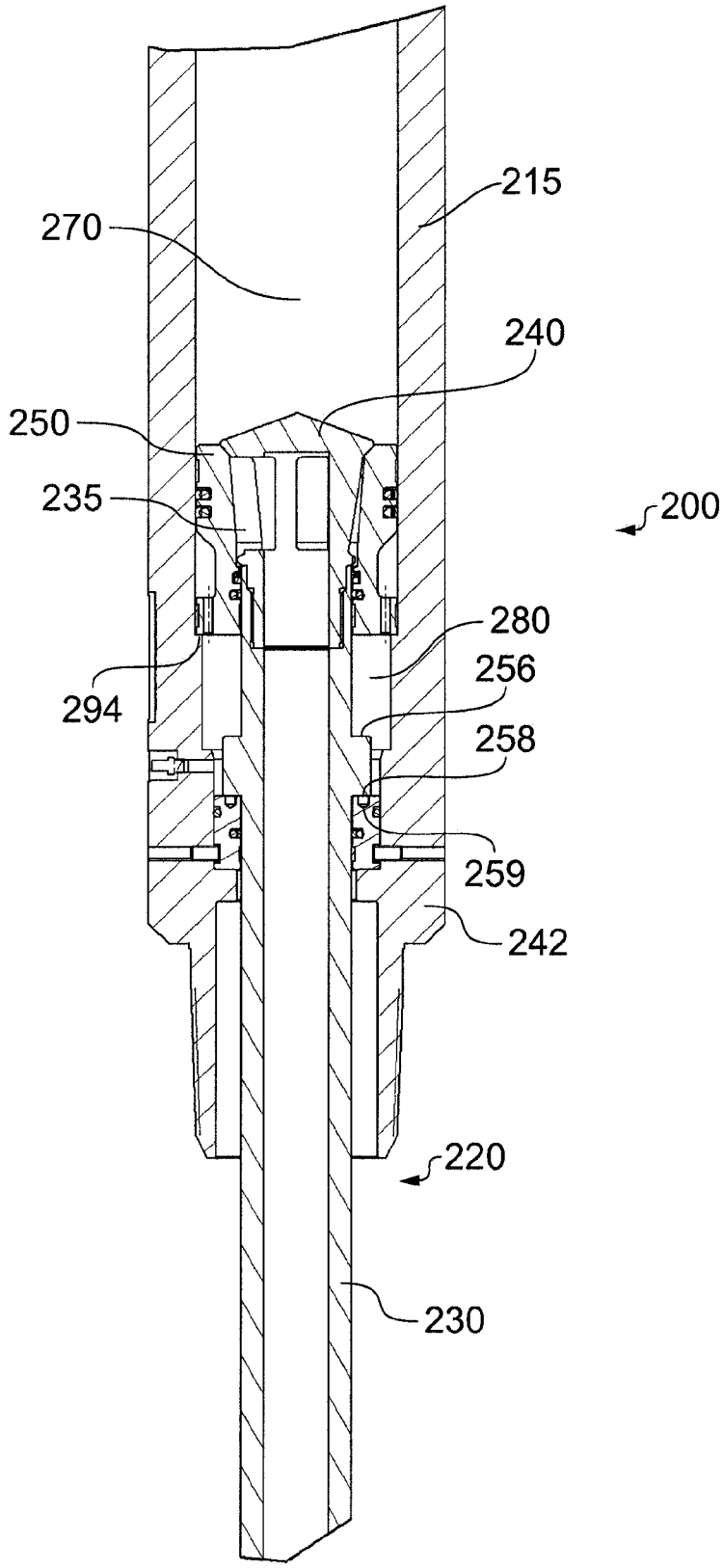
FIG. 7 is a sectional side view of a portion of the hydraulic connector according to a second embodiment of the present disclosure and shows further details of the valve assembly.

With reference to FIG. 7, a hydraulic connector 200 according to a second embodiment of the present disclosure may comprise a further abutment surface 294 provided on an inner wall of cylinder 215. The second embodiment may otherwise be identical to the first embodiment. For example, the hydraulic connector 200 may comprise a sealing assembly provided at a distal end of an extendable portion 220, which may be selectively extendable from cylinder 215 to engage a downhole tubular. The extendable portion 220 may comprise a tubular rod 230 with a piston 250 slidably disposed about the tubular rod 230 and between a cap 240 and second abutment surface 256 provided on the tubular rod. The tubular rod 230 may also be provided with a first abutment surface 258 arranged to contact a corresponding abutment surface 259 provided on an end plug 242 of the cylinder 215 when the extendable portion 220 is at maximum stroke. The piston 250 may slide to reveal holes 235 provided in a side wall of the tubular rod 230, thereby selectively permitting flow from a second (upper) chamber 270, through the tubular rod 230 and hence connector 200. Movement of the piston 250 may be resisted by first fluid held in a first (lower) chamber 280.

The further abutment surface 294 may be positioned to limit travel of the piston 250 when the extendable portion has fully extended, e.g. when the first abutment surface 258 has contacted the corresponding abutment surface 259. Thus, if the extendable portion 220 extends fully from cylinder 215 before the sealing assembly fully engages the string of downhole tubulars 4, the piston 250 will be prevented from lowering further by contact against the further abutment surface 294. The piston 250 may not slide away from the cap 240 and the holes 235 will remain closed. The further abutment surface 294 may thus ensure that no drilling mud is spilt if the extendable portion 220 does not engage a string of downhole tubulars 4. The hydraulic connector 200 of the second embodiment otherwise functions in the same way as the hydraulic connector 100 of the first embodiment.

As described above, the hydraulic connector 100, 200 of either embodiment may replace a traditional threaded connection between a top-drive 2 and downhole tubulars 4 during tripping operations of the downhole tubulars 4 into or out of a well. With this connector (e.g., 100, 200), the connection between the top-drive 2 and downhole tubulars 4 may be established in a much shorter time and at greater savings. Nevertheless, should it be desirable, the threaded portion 110, 210 may enable the hydraulic connector 100, 200 to be rigidly connected to the downhole tubulars directly by means of a traditional threaded connection. In this manner, the hydraulic connector 100, 200 may be connected to a drill string or a casing string for the transmission of torque and/or axial load. Threaded portion 110, 210 may connect to a downhole tubular of any size by using an intermediate swage.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the invention should be limited only by the attached claims.

What is claimed is:

1. A hydraulic connector to provide a fluidic connection between a fluid supply and a downhole tubular, the connector comprising:

a body;

an engagement assembly comprising an extendable portion selectively extendable from the body, the engagement assembly being configured to extend and retract a seal assembly disposed at a distal end of the extendable portion into and from a proximal end of the downhole tubular; and a valve assembly operable between an open position and a closed position, the valve assembly being configured to: allow a fluid to communicate between the fluid supply and the downhole tubular through the seal assembly when in the open position; and prevent fluid communication between the fluid supply and the downhole tubular when in the closed position, wherein the extendable portion comprises a first abutment surface disposed to limit the extension of the engagement assembly by contact of the first abutment surface with a corresponding abutment surface of the body, wherein the engagement assembly comprises a piston disposed about the extendable portion and divides a cylinder defined by the body portion into a first chamber and a second chamber, and wherein the piston comprises a third chamber and one or more passages, the one or more passages fluidicly connecting the third chamber to the first chamber.

2. The hydraulic connector of claim 1, wherein the first chamber contains pressurised fluid to retract the extendable portion.

3. The hydraulic connector of claim 1, wherein the first chamber is sealed to define a substantially closed system.

4. The hydraulic connector of claim 1, wherein the first chamber comprises a valve connectable to a source of pressurised fluid, the valve permitting the first chamber to be charged and/or recharged with pressurised fluid.

5. The hydraulic connector of claim 1, wherein the second chamber is in communication with drilling mud to extend the seal assembly.

6. The hydraulic connector of claim 1, wherein the extendable portion comprises a cap, the piston being configured to be displaced away from the cap when the valve assembly is in the open position.

7. The hydraulic connector of claim 1, wherein the extendable portion comprises a through bore extending between the piston and the seal assembly to allow the fluid to communicate between the fluid supply and the downhole tubular.

8. The hydraulic connector of claim 1, wherein the piston is slidably disposed between a cap and the second abutment surface provided on the extendable portion.

9. The hydraulic connector of claim 8, wherein the extendable portion comprises an annulet, the annulet forming the first and second abutment surfaces.

10. The hydraulic connector of claim 1, wherein the engagement assembly is configured to extend the seal assembly when a pressure of fluids in the fluid supply exceed a threshold value.

11. The hydraulic connector of claim 1, wherein the extendable portion comprises a second abutment surface disposed to limit the travel of a piston.

12. The hydraulic connector of claim 1, wherein the body comprises a threaded portion disposed at a distal end of the body, the threaded portion being configured to threadably engage a threaded section in the proximal end of the downhole tubular.

13. The hydraulic connector of claim 12, wherein the threaded portion threadably engages the downhole tubular inside a box threaded end of the downhole tubular.

14. The hydraulic connector of claim 1, wherein the seal assembly is configured to seal against a bore of the downhole tubular beyond a threaded section in the proximal end of the downhole tubular.

15. The hydraulic connector of claim 1, wherein the fluid supply comprises a top-drive assembly.

16. A hydraulic connector to provide a fluidic connection between a fluid supply and a downhole tubular, the connector comprising:

a body;

an engagement assembly comprising an extendable portion selectively extendable from the body, the engagement assembly being configured to extend and retract a seal assembly disposed at a distal end of the extendable portion into and from a proximal end of the downhole tubular; and a valve assembly operable between an open position and a closed position, the valve assembly being configured to: allow a fluid to communicate between the fluid supply and the downhole tubular through the seal assembly when in the open position; and prevent fluid communication between the fluid supply and the downhole tubular when in the closed position, wherein the extendable portion comprises a first abutment surface disposed to limit the extension of the engagement assembly by contact of the first abutment surface with a corresponding abutment surface of the body, and wherein the seal assembly is retractable within the distal end of the body.

17. A method of providing a fluidic connection between a fluid supply and a downhole tubular using a hydraulic connector, the method comprising:

providing the hydraulic connector with a body, a valve assembly, a seal assembly and an engagement assembly, the engagement assembly comprising an extendable portion with the seal assembly disposed upon a distal end of the extendable portion;

extending the extendable portion until a first abutment surface disposed on the extendable portion abuts a corresponding abutment surface of the body;

engaging the seal assembly within a proximal end of the downhole tubular;

opening the valve assembly;

hydraulically communicating fluid between the fluid supply and the downhole tubular; and retracting the seal assembly within the distal end of the body.

18. The method of claim 17, further comprising:

providing the engagement assembly with a piston disposed about the extendable portion and configured to divide a cylinder defined by the body portion into a first chamber and a second chamber;

sealing the first chamber such that it defines a substantially closed system; and providing the first chamber with pressurised fluid to resist extension of the extendable portion.

19. The method of claim 18, further comprising:

allowing the pressurised fluid in the first chamber to expand against the piston to retract the extendable portion.

20. The method of claim 18, further comprising:

charging and/or recharging the first chamber with pressurised fluid.

21. The method of claim 17, further comprising:

reducing the pressure of fluids in the fluid supply;

closing the valve assembly; and retracting the seal assembly from the proximal end of the downhole tubular.

22. The method of claim 17, further comprising:

providing the extendable portion with a second abutment surface; and limiting the travel of the piston about the extendable portion by contact with the second abutment surface.

23. A method of providing a fluidic connection between a fluid supply and a downhole tubular using a hydraulic connector, the method comprising:

providing the hydraulic connector with a body, a valve assembly, a seal assembly; and an engagement assembly, the engagement assembly comprising an extendable portion with the seal assembly disposed upon a distal end of the extendable portion;

providing the engagement assembly with a piston disposed about the extendable portion and configured to divide a cylinder defined by the body portion into a first chamber and a second chamber;

sealing the first chamber such that it defines a substantially closed system;

providing the first chamber with pressurised fluid to resist extension of the extendable portion;

increasing a pressure of fluids in the fluid supply;

extending the extendable portion;

resisting movement of the piston tending to reduce the volume of the first chamber;

engaging the seal assembly within a proximal end of the downhole tubular;

opening the valve assembly;

hydraulically communicating fluids between the fluid supply and the downhole tubular; and retracting the seal assembly within the distal end of the body.

24. The method of claim 23, further comprising:

extending the extendable portion until a first abutment surface disposed on the extendable portion abuts a corresponding abutment surface of the body.

* * * * *